US008394319B2

(12) United States Patent
Watanabe et al.

(10) Patent No.: US 8,394,319 B2
(45) Date of Patent: Mar. 12, 2013

(54) MARTENSITIC-STEEL CASTING MATERIAL AND PROCESS FOR PRODUCING MARTENSITIC CAST STEEL PRODUCT

(75) Inventors: Toshitaka Watanabe, Yamagata (JP); Toru Yamada, Yamagata (JP); Noboru Sato, Yamagata (JP); Satoshi Nakano, Yamagata (JP); Toshiro Matsuki, Yamagata (JP)

(73) Assignees: Yamagataken, Yamagata-Shi (JP); Yugen Kaisha Watanabe Chuzo-Sho, Yamagata-Shi (JP)

( * ) Notice: Subject to any disclaimer, the term of this patent is extended or adjusted under 35 U.S.C. 154(b) by 0 days.

(21) Appl. No.: 13/138,477

(22) PCT Filed: Feb. 19, 2010

(86) PCT No.: PCT/JP2010/052510

§ 371 (c)(1),
(2), (4) Date: Oct. 5, 2011

(87) PCT Pub. No.: WO2010/098256

PCT Pub. Date: Sep. 2, 2010

(65) Prior Publication Data

US 2012/0014626 A1 Jan. 19, 2012

(30) Foreign Application Priority Data

Feb. 24, 2009 (JP) ..... 2009-040864

(51) Int. Cl.
*C22C 38/46* (2006.01)
*C22C 38/40* (2006.01)
*C21D 6/04* (2006.01)

(52) U.S. Cl. ..... 420/112; 420/111; 420/118; 148/333; 148/336; 148/578

(58) Field of Classification Search ..... 148/578, 148/325, 327, 333–335, 577, 320, 336; 420/104–112, 118, 117
See application file for complete search history.

(56) References Cited

U.S. PATENT DOCUMENTS
(Continued)

FOREIGN PATENT DOCUMENTS

JP 59-143079 A 8/1984
JP 60-052562 A 3/1985

(Continued)

OTHER PUBLICATIONS

Machine-English translation of Japanese patent 08-311616, Hiratsuka Yukiji et al., Nov. 26, 1996.*

(Continued)

*Primary Examiner* — Deborah Yee
(74) *Attorney, Agent, or Firm* — Pearne & Gordon LLP

(57) ABSTRACT

Nickel, Ni, of 5 to 10 mass %, silicon, Si, of 0.5 to 5 mass %, manganese, Mn, of 0.01 to 1 mass %, carbon, C, of 0.2 to 2 mass % and a remaining part consisting of iron, Fe, and incidental impurities are employed, and further chromium, Cr, of 1 to 10 mass % is added to obtain a martensitic cast steel material for which a martensitic transformation finish temperature (Mf point) is below freezing. Further, a cast steel material that contains vanadium V of 0.1 to 5 mass % in addition to the above elements of the material is also obtained. For these cast steel materials, since martensitic transformation occurs merely by performing a sub-zero treatment, the tempering process can be comparatively easily performed, and machining in a desired shape is easily performed.

16 Claims, 18 Drawing Sheets
(2 of 18 Drawing Sheet(s) Filed in Color)

U.S. PATENT DOCUMENTS

| | | | | | |
|---|---|---|---|---|---|
| 2,978,319 | A | * | 4/1961 | Chang | 420/109 |
| 3,152,934 | A | * | 10/1964 | Lula et al. | 148/578 |
| 3,366,471 | A | * | 1/1968 | Matas et al. | 420/8 |

FOREIGN PATENT DOCUMENTS

| | | | |
|---|---|---|---|
| JP | 62-027554 | A | 2/1987 |
| JP | 63-293143 | A | 11/1988 |
| JP | 09-053160 | A | 2/1997 |
| JP | 2003-277879 | A | 10/2003 |
| JP | 2004-270002 | A | 9/2004 |
| JP | 2006-104573 | A | 4/2006 |
| JP | 2006-206986 | A | 8/2006 |

OTHER PUBLICATIONS

International Search Report for PCT/JP2010/052510; May 25, 2010.

* cited by examiner

Die-forming Steel (A)

Die-forming Stainless Steel (B)

Externally Appearances of Commercially Available Materials after Corrosion Test (100 hours) using Tap Water was conducted.

2%Cr
(A)

3%Cr
(B)

External Appearances of Cast Steel Material of this Invention after Corrosion Test (100 hours) using Tap Water was conducted.

XPS (ESCA) analysis of oxide film formed on die-forming stainless steel B

XPS (ESCA) analysis of oxide film formed on 2%Cr developed material

MARTENSITIC-STEEL CASTING MATERIAL AND PROCESS FOR PRODUCING MARTENSITIC CAST STEEL PRODUCT

TECHNICAL FIELD

The present invention relates to an inexpensive martensitic cast steel material that has a hardness equivalent to hardened steel or prehardened steel and exhibits superior corrosion resistance in wet environments, and a process for manufacturing martensitic steel casting products.

BACKGROUND ART

Materials that have improved fracture toughness, such as cast iron materials or cast steel materials, are widely employed for the components, the constructional parts and the movable members of various apparatuses and machines. For example, for the stages, the support members and the driver components of precision machinery for which high accuracy is required, casting molds, plastic injection molds and aluminum die casting molds, a cast steel material that has a low thermal expansion coefficient and stable properties is a prerequisite. Especially for precision machines employed in cold areas or high temperature areas, the affect of thermal expansion should be minimized. Therefore, a material for which martensitic transformation has been at least partially completed is requested.

In order to respond to such a technological request, cast iron having superior wear resistance and corrosion resistance, and that is appropriate for use as a cylinder liner, is disclosed in patent literature 1. For satisfying such an intended purpose, this cast iron contains high densities of phosphorus (P) and boron (B), and a surface hardened layer (steadite) is dispersed. However, since martensitic transformation is not performed for this material, it is understood that acquisition of a satisfactory hardness, such as HRC 30 or greater, is difficult for the cast iron. Patent literature 2 discloses cast iron that exhibits superior heat resistance and corrosion resistance at high temperatures in corrosive gas atmospheres, and also demonstrates a superior wear resistance. This cast iron contains a large amount of chromium Cr, 30 to 50 mass %, for example, and is very hard and brittle. According to the description in patent literature 2, the cast iron is employed for the fire gate of an incinerator, as an example, and is not an appropriate material for forming machinery components and molds. In order to increase the hardness of the base metal of the cast iron, a conventional, common high-temperature heat-treatment (quenching) is required.

In patent literature 3, a martensitic cast steel material is disclosed, in which nickel, Ni, manganese, Mn, silicon, Si, and carbon, C, are contained at predetermined ratios and the remaining part consists of iron, Fe, and incidental impurities, and for which the martensitic transformation start temperature is near a room temperature and the martensitic transformation finish temperature is below freezing, and a manufacturing method is also disclosed, for melting such a martensitic cast steel material to produce steel casting products that are shaped almost as are final products. According to the martensitic steel casting product manufacturing method that is disclosed, a sub-zero treatment (deep freezing) is performed for such obtained steel casting products at 0° C. to −200° C., and thereafter, a tempering process is performed at a required temperature. Then, either the sub-zero treatment or the tempering process is repeated, as needed, and a finishing process is performed. Since the hardness of a martensitic steel casting product can be increased simply by performing the sub-zero treatment, thus obtained martensitic steel casting product is an appropriate material to use for casting elevator sheaves, various industrial machinery wheels, etc. However, improved corrosion resistance is still required, so that the cast steel material can also be used in wet environments. It has long been known that adding chromium, Cr, to ferrous materials is an effective means by which to improve corrosion resistance. However, when chromium, Cr, is added to a cast iron or cast steel material, hard and brittle carbide is generated that, as the structural material of a machine, would cause the deterioration of important properties, such as ductility and toughness, so that as yet, such a steel casting product has not been put to use.

[Citation List]
Patent Literature
[PTL 1]
Japanese Unexamined Patent Publication No. 2006-206986
[PTL 2]
Japanese Unexamined Patent Publication No. 2004-270002
[PTL 3]
Japanese Unexamined Patent Publication No. 2006-104573

SUMMARY OF INVENTION

Technical Problem

One objective of the present invention is to provide a martensitic cast steel material that exhibits an improved corrosion resistance in wet environments, which is a problem for a martensitic cast steel material and martensitic steel casting products that are produced as in patent literature 3, also filed by the present inventor, and that can also be employed, for example, for injection molds, press dies and aluminum die casting molds, and to provide a process for manufacturing martensitic steel casting products.

Solution to Problem

The present invention according to claim 1 is a martensitic cast steel material, characterized in that:

nickel, Ni, of 5 to 10 mass %, chromium, Cr, of 1 to 10 mass %, silicon, Si, of 0.5 to 5 mass %, manganese, Mn, of 0.01 to 1 mass %, carbon, C, of 0.2 to 2 mass %, and a remaining part consisting of iron, Fe, and incidental impurities are contained; and a martensitic transformation finish temperature (Mf point) is below freezing. Further, according to claim 2, the martensitic cast steel material in claim 1 is characterized in that vanadium, V, of 0.1 to 5 mass %, is also contained. As described in claim 3, this cast steel material is characterized by having a property that the martensitic transformation is completed simply by performing a sub-zero treatment (deep freezing).

The invention according to claim 4 is characterized in that:

a temperature range for the sub-zero treatment is from 0° C. to −200° C.; and when the sub-zero treatment is performed for a cast steel material, in an as-cast state, that has a Rockwell C hardness scale of HRC 20 to 60, a property of hardness of HRC 45 to 65 is obtained. As described in claim 5, since following the sub-zero treatment, tempering is performed for the martensitic cast steel material thus obtained, a property is obtained such that the hardness can be adjusted within a desired range of HRC 40 to 60.

The invention according to claim 6 is the martensitic cast steel material, characterized in that:

the cast steel material obtained by the sub-zero treatment is machined to produce a desired shape, and thereafter, the shaped cast steel material is tempered in an atmosphere wherein nitrogen surface enrichment readily occurs, is performed; and a property is obtained such that the surface of the obtained steel casting product can be adjusted within a desired range of 700 to 1200 HV.

The invention according to claim 7 is a manufacturing process for a martensitic steel casting product, characterized by comprising the steps of:

melting a raw material whose elements are adjusted as is described above;

casting the raw material to obtain a shape near that of a final product;

performing a finishing process for the thus obtained steel casting product;

performing a sub-zero treatment, at a temperature of 0° C. to −200° C., for the finished steel casting product; and tempering the resultant steel casting product at a required temperature. Further, the invention according to claim 8 is a manufacturing process for a martensitic steel casting product, characterized by comprising the steps of:

melting a raw material whose elements have been adjusted as described above;

performing a sub-zero treatment, at a temperature of 0° C. to −200° C., for a thus obtained cast steel ingot;

tempering the obtained cast steel ingot at a required temperature; and machining the cast steel material obtained by tempering to obtain a desired product.

The invention in claim 9 is a manufacturing process for a martensitic steel casting product, characterized by comprising the steps of:

melting a raw material whose elements are adjusted as described above;

performing a sub-zero treatment, at a temperature of 0° C. to −200° C., for an obtained cast steel ingot:

machining the cast steel material obtained by the sub-zero treatment to produce a desired shape;

tempering the produced steel casting product in an atmosphere wherein nitrogen surface enrichment readily occurs, and producing a desired product.

For the martensitic steel casting product manufacturing process in claim 7 or 8, the invention according to claim 10 is characterized in that a temperature for the sub-zero treatment is set that is equal to or lower than −50° C., and the invention according to claim 11 is characterized in that a temperature for the tempering is selected from within a range of 100° C. to 700° C., and in accordance with a product type and required properties. Further, for the martensitic steel casting product manufacturing method in claim 9, the invention according to claim 12 is characterized in that a temperature, for tempering performed in an atmosphere in which nitrogen surface enrichment readily occurs, is selected from within a range of 400° C. to 600° C., and in accordance with a product type and required properties.

The invention according to claim 13 is a locating pin, employed for steel sheet stamping, that is characterized in that:

the above described martensitic cast steel material is melted and cast into a shape near that of a finished product;

a sub-zero treatment, at −50° C. or lower, and finishing are performed, in the named order, for the obtained cast steel material;

the resultant steel material is tempered in an atmosphere in which nitrogen surface enrichment readily occurs, so that surface hardness of a finished product is adjusted in a range of 700 HV to 1200 HV.

The invention according to claim 14 is a plastic injection molding die, provided with a temperature-control tube, characterized in that:

when a molding die is to be formed using a desirably shaped mold, a temperature-control metal tube having a desired shape, such that temperature unevenness will be avoided throughout the entire cavity, is positioned in the mold, in advance, the above described martensitic cast steel material is melted and is cast with the temperature-control metal tube, and thereafter, a sub-zero treatment at −50° C. or lower and a tempering process are performed, so as to obtain a desired hardness. Furthermore, the invention, according to claim 15, is an aluminum die-casting die, provided with a temperature-control tube, characterized in that:

when a molding die is to be formed using a desirably shaped mold, a temperature-control metal tube having a desired shape, such that temperature unevenness will be avoided throughout the entire cavity, is positioned in the mold, in advance, the above described martensitic cast steel material is melted and is cast with the temperature-control metal tube, and thereafter, a sub-zero treatment at −50° C. or lower and a tempering process are performed, so as to obtain a desired hardness.

The invention according to claim 16 is a hot runner manifold block, provided with a resin channel and a temperature-control tube, characterized in that:

a desirably shaped molten resin channel and a temperature-control metal tube also having a desired shape are arranged in advance in a mold, and are cast together when the above described martensitic steel material is melted and cast into a shape near that of a finished product, and thereafter, a sub-zero treatment at −50° C. or lower and a tempering process are performed, so as to obtain a desired hardness.

The invention according to claim 17 is a plain bearing, characterized in that:

the above described martensitic cast steel material is melted and cast into a shape near that of a finished product;

a sub-zero treatment, at −50° C. or lower, and finishing are performed, in the named order, for the obtained steel product;

the resultant steel product is tempered in an atmosphere in which nitrogen surface enrichment readily occurs, so that surface hardness of a finished product is adjusted in a range of 700 HV to 1200 HV.

Advantageous Effects of Invention

For the martensitic cast steel material produced at the element ratio designated in the present invention, transformation to martensite is enabled simply by performing a sub-zero treatment at a temperature of 0° C. or lower, and a hardening process at a high temperature, which is a requisite process for a conventional method, is not required. It is understood that the martensitic transformation that occurs during the sub-zero treatment depends only on a treatment temperature and is not directly affected by a holding time period, and when the actual temperature of an object is equal to or lower than the martensitic transformation finish temperature (Mf point), no further transformation will occur. For this invention, a predetermined amount of chromium, Cr, is added to the martensitic cast steel material; and when the added quantity of chromium, Cr, is carefully reviewed, the generation of hard, brittle carbide is suppressed, and corrosion resistance, especially in wet environments, is remarkably improved, without deterioration of other important properties, such as ductility and toughness, required of structural materials employed for machinery.

Martensitic transformation of a steel casting product is completed when the Mf point is reached, and an unevenness in the hardness, due to a difference in the thickness of the steel casting product or a difference in a cooling speed, seldom appears. Therefore, so-called near-net shape forming can be employed, according to which a material is cast in a mold to obtain a shape near that of the final shape that is expected, and the simple finishing process is performed whereby the final shape of the product is produced. Therefore, a so-called desired product can be obtained merely by performing a minor finishing process, and from a viewpoint that, since there is a reduction in the number of steps and an improved production yield, this forming process is useful. Further, since a hardening process at a high temperature, such as 800° C. to 1200° C., is not required, great savings in energy can be expected. Especially in a case wherein a great quantity of large components are manufactured, an enormous amount of energy is required for high-temperature heating to perform the hardening process, and thus, the present invention will provide great energy saving effects. Since a reduction in the consumption of fossil fuel is being implemented, it is also expected that the present invention will greatly contribute to a reduction in carbon dioxide emissions, which is regarded as a main cause of global warming.

When the conventional hardening process is performed at a high temperature, thermal strain or thermal deformation of a product is likely to occur, and accordingly, it is highly probable that a major finishing process and additional correction will be required following the hardening process. However, during the sub-zero treatment performed in this invention, such an inconvenience seldom occurs. When the sub-zero treatment is performed following casting and finishing, the martensitic transformation is completed, and thereafter, either a correction process is not required, or only an extremely minor correction need be performed, so that the number of processes and man-hours required can be reduced, and the manufacturing costs can be sharply reduced. For the martensitic cast steel material of this invention, after the martensitic transformation has occurred, tempering and other necessary machining can also be performed.

Examples produced by performing "machining after treatment", where machining is performed following tempering of the martensitic cast steel material of this invention, are: copper alloy plates or wear plates employed for sliding portions; lapping machines for polishing semiconductor wafers; general edged tools, such as scissors, nippers, razor blades, and kitchen knives and other types of knives; blades of office machines, such as shredders and cutters; lead line cutters; pelletizer rotary cutter blades for cutting plastic strands; blades of industrial machines, such as mills and paper converters; injection molding dies; construction machinery parts; and impellers and runners for fluid machinery, such as turbines and pumps.

Examples produced by performing "machining before treatment", where machining is performed before the sub-zero treatment, are: press dies; injection molding dies; aluminum die-cast dies; tools for which hardness and precision at a predetermined level or higher are required; gears; forged products, such as vehicle suspension parts and shafts; parts for rail transport vehicles; eyebolts; beds and sliding members of machine tools; parts of agricultural machinery tools, such as rice polishing machines and threshing machines; pawls, cutting portions, etc., of construction machinery; blades of lawnmowers, snowplows, etc., or fixed cutting blades; and parts of continuous (caterpillar) tracks.

Further, examples produced by enclosing a required component, such as an electric heater with a protective tube, various types of sensors or temperature-control tubes in a cast steel material, are: barrels and screws of plastic melting-kneading extruders; and injection molding dies that require more accurate temperature control for heating or cooling. Further, examples produced by casting, in a mold, not only a linear tube, but also a bent tube for temperature control, are: blackbody furnaces; furnace bodies for PVD, CVD, dry etching, wet etching, etc.; plasma generators; furnace bodies for semiconductor processing equipment; steppers and aligners for manufacturing semiconductor masks; precision temperature control mechanisms for the sliding faces of precision machine tools; and temperature control tubes or lubricating oil tubes for various engine parts, such as cylinder liners and engine blocks. Since various tubes employed for cooling, temperature control and lubricating can be easily cast in a mold, a reduction in required man-hours, an improvement in production yield and a reduction in consumed energy can be expected for the manufacturing and machining processes.

BRIEF DESCRIPTION OF DRAWINGS

The patent or application file contains at least one drawing executed in color. Copies of this patent or patent application publication with color drawing(s) will be provided by the Office upon request and payment of the necessary fee.

Figure 1:
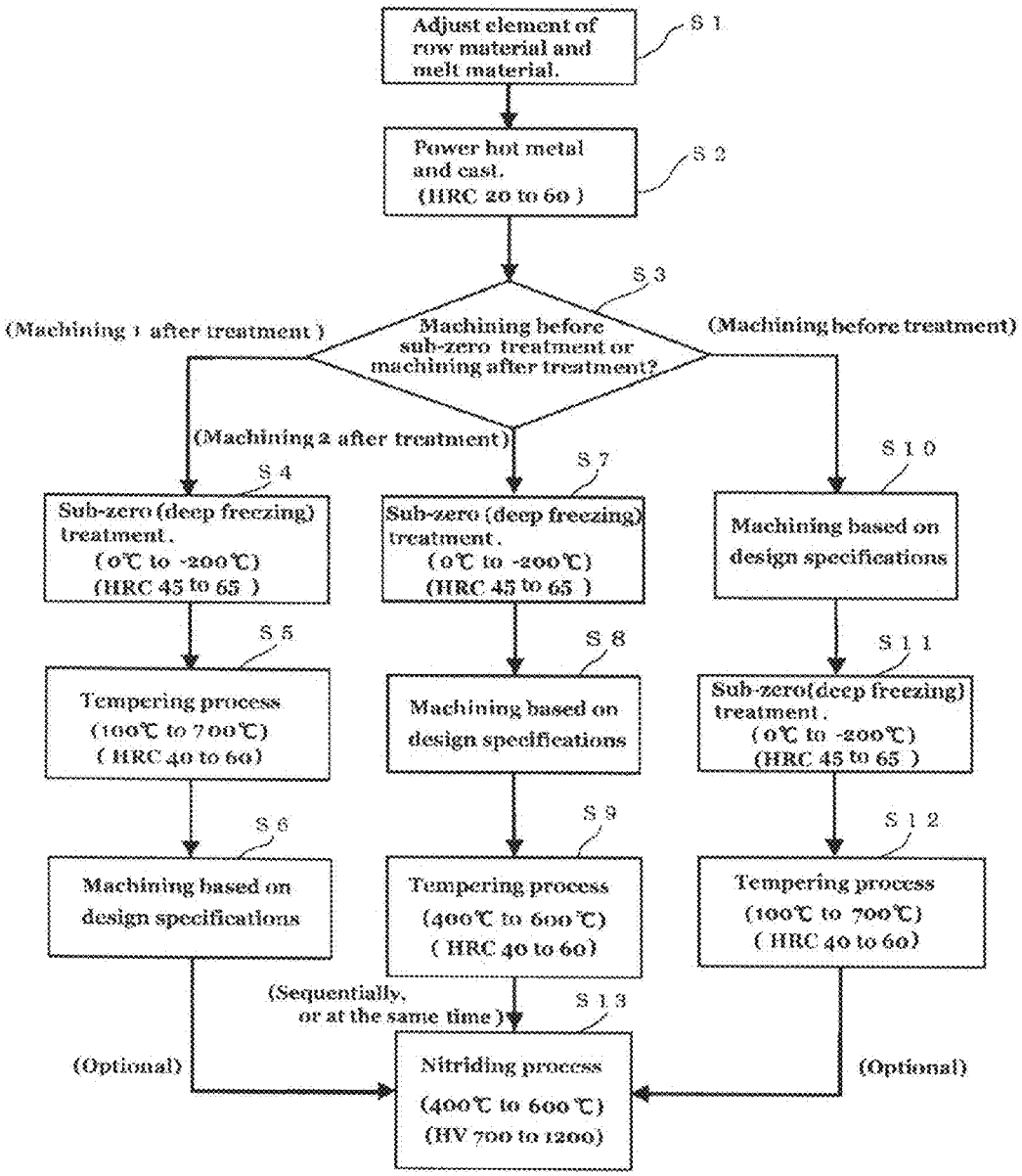
[FIG. 1]

A flowchart showing the main processing for a method for manufacturing martensitic steel casting products according to the present invention.

[FIG. 2]

A graph showing a relationship, between a sub-zero treatment temperature and a Rockwell hardness, that is accompanied by a change of the amount of nickel contained in a martensitic steel casting product.

[FIG. 3]

A graph showing a relationship, between a sub-zero treatment temperature and a Rockwell hardness, that is accompanied by a change in the amount of chromium contained in a martensitic steel casting product.

[FIG. 4]

A graph showing a relationship, between a sub-zero treatment temperature and a Rockwell hardness, that is accompanied by a change in the amount of silicon contained in a martensitic steel casting product.

[FIG. 5]

A graph showing a relationship, between a sub-zero treatment temperature and a Rockwell hardness, that is accompanied by a change in the amount of carbon contained in a martensitic steel casting product.

[FIG. 6]

A graph showing a relationship, between a sub-zero treatment temperature and a Rockwell hardness, that is accompanied by a change in the amount of vanadium contained in a martensitic steel casting product.

[FIG. 7]

A graph showing a relationship, between a tempering temperature and a Rockwell hardness, that is accompanied by a change in the amount of nickel contained in a martensitic steel casting product.

[FIG. 8]

A graph showing a relationship, between a tempering temperature and a Rockwell hardness, that is accompanied by a change in the amount of chromium contained in a martensitic steel casting product.

[FIG. 9]

A graph showing a relationship, between a tempering temperature and a Rockwell hardness, that is accompanied by a change in the amount of silicon contained in a martensitic steel casting product.

[FIG. 10]

A graph showing a relationship, between a tempering temperature and a Rockwell hardness, that is accompanied by a change in the amount of carbon contained in a martensitic steel casting product.

[FIG. 11]

A graph showing a relationship, between a tempering temperature and a Rockwell hardness, that is accompanied by a change in the amount of vanadium contained in a martensitic steel casting product.

[FIG. 12]

A photograph showing a steel surface, indicating the results obtained by conducting a corrosion test, using running tap water, for a die-forming steel material A, available on the market, and a die-forming stainless steel material B, also available on the market.

[FIG. 13]

A photograph showing a steel surface, indicating the results obtained by conducting a corrosion test, using running tap water, for martensitic cast steel materials of the present invention, for which the chromium contents were 2% and 3%, respectively.

[FIG. 14]

A graph showing XPS analysis results for an oxide film that is generated on the surface of the die-forming stainless steel material B, which is available on the market.

[FIG. 15]

A graph showing XPS analysis results for an oxide film that is generated on the surface of the martensitic cast steel material of the present invention that contains 2% of chromium.

[FIG. 16]

A graph showing changes in the widths of wear tracks, obtained by conducting a wear test for the martensitic cast steel material (developed material) of the present invention and the die-forming steel material A that is available on the market.

[FIG. 17]

A graph showing changes in wear losses, obtained by conducting a wear test for the martensitic cast steel material (developed material) of the present invention and the die-forming steel material A that is available on the market.

[FIG. 18]

A graph showing a relationship of a hardness distribution between the martensitic cast steel material (nitrided) of the present invention and the die-forming stainless steel material B that is available on the market.

DESCRIPTION OF EMBODIMENT

The present invention discloses the contents and properties of a martensitic cast steel material, and a manufacturing method for such a martensitic cast steel material. For manufacturing the martensitic cast steel material of this invention, the elements of a raw material are adjusted, and melting of the raw material is performed at step S1, in a flowchart in FIG. 1. The composition ratio is adjusted to Nickel, Ni, of 5 to 10 mass %, preferably 5 to 9 mass %, chromium, Cr, of 1 to 10 mass %, preferably 2 to 8 mass %, silicon, Si, of 0.5 to 5 mass %, preferably 1 to 2.5 mass %, manganese, Mn, of 0.01 to 1 mass %, preferably 0.05 to 0.5 mass %, carbon, C, of 0.2 to 2 mass %, preferably 0.3 to 0.8 mass %, and Fe for the remaining part (corresponding to claim 1), and further, in addition to these elements, vanadium, V, of 0.1 to 2 mass % is contained (corresponding to claim 2). The material prepared at this composition ratio is melted using well known melting equipment, such as a high-frequency induction furnace (step S1).

A predetermined amount of molten metal, obtained through the element adjusting and melting process, is transferred to an ingot mold that is prepared in advance, and a cast steel material of HRC 20 to 60, in the as-cast state, is obtained (step S2). For the thus obtained cast steel material, the sub-zero treatment performed to increase hardness and the tempering process, performed to provide an appropriate hardness for a final product, must be performed at arbitrary processing stages. Therefore, the performance of the process is selected from "machining 1 after treatment", for at first performing the sub-zero treatment and tempering, and for secondly performing machining in accordance with basic dimension and design specifications, "machining 2 after treatment", for at first performing the sub-zero treatment and machining in accordance with basic dimension and design specifications, and secondly performing the tempering process, and "machining before treatment", for at first performing machining in accordance with basic dimension and design specifications, and secondly performing the sub-zero treatment (step S3).

When "machining 1 after treatment" is selected, the sub-zero treatment (deep freezing) is performed for the cast steel ingot at a temperature of 0° C. to −200° C., preferably −50° C. to −80° C., so that martensitic transformation occurs (step S4), and thereafter, the tempering process is performed for the cast steel material to obtain a hardness of HRC 40 to 60, which is appropriate for performing machining (step S5). Then, the cast steel material having the adjusted hardness is machined in accordance with the design specifications (step S6).

When "machining 2 after treatment" is selected at step S3, the sub-zero treatment (deep freezing) is performed for the cast steel ingot at a temperature of 0° C. to −200° C., preferably −50° C. to −80° C., so that martensitic transformation occurs (step S7). Then, the thus obtained cast steel material is machined in accordance with the design specifications (step S8). Thereafter, the tempering process is performed at 400° C. to 600° C. (step S9). Further, the nitriding process is performed at 400° C. to 600° C. to obtain a steel casting product having a hardness of 700 to 1200 HV (step S13). The processes at step S9 and S13 maybe performed at the same time. Furthermore, following the process at step S6 or S12, the nitriding process at step S13 may be arbitrarily performed.

When "machining before treatment", which is a near-net shaping process, is selected at step S3, the cast steel material is machined, in accordance with the design specifications, so as to be formed into a shape near that of a final product (step S10), and thereafter, the heating process is performed. In this case, the sub-zero treatment, in a temperature range of 0° C. to −200° C., is performed for the steel casting product obtained by machining, and a desired hardness (e.g., HRC 45 to 65) is obtained (step S11). Thereafter, the tempering process is performed to adjust the hardness, as needed, to the optimal hardness (e.g., HRC 40 to 60), and to provide facture toughness (step S12).

For the cast steel material obtained based on the above described composition ratio range, the martensitic transformation finish temperature (Mf point) is below freezing. Therefore, the sub-zero treatment can be performed in a temperature range, such as −50° C. to −80° C., that can be provided by a freezer, which is a common, easily available industrial chiller, so that a martensitic steel casting product can be produced not only through simple processing, and with reduced energy consumption, but also at a low manufacturing cost. Further, conventionally, since the ordinary hardening process must be performed at a high temperature of about 800° C. to 1200° C., an enormous amount of thermal energy is required, in accordance with the heat capacity of a steel casting product, and a great amount of heat is required, especially for a large product. However, according to the present invention, the amount of heat energy required for tempering the martensitic cast steel material can be effectively reduced.

The composition of the martensitic cast steel material of the present invention will be reviewed. In Table 1 below, data are presented for example hardness (HRC) changes for the martensitic cast steel materials of the present invention, for which the sub-zero treatment and tempering were performed. The leftmost column shows the individual contents of nickel, Ni, chromium, Cr, silicon, Si, carbon, C, and vanadium, V. The topmost row shows, from the left, an as-cast state (one column for 20° C.), sub-zero (treatment) temperatures (three columns for −50° C., −80° C. and −196° C.) and tempering (processing) temperatures (five columns for 200° C., 400° C., 500° C., 600° C. and 700° C.). The right end five columns show the content ratios for the other elements, relative to the individual elements shown in the left column.

TABLE 1

Hardness (HRC) Changes by Sub-Zero Treatment for Martensitic Cast Steel Materials

| | As-Cast | Sub-Zero Temperatures (° C.) | | | Tempering Temperature (° C.) | | | | | | | | | |
|---|---|---|---|---|---|---|---|---|---|---|---|---|---|---|
| | (20° C.) | −50 | −80 | −196 | 200 | 400 | 500 | 600 | 700 | Ni | Cr | Si | C | V |
| 6.5Ni | 59.0 | 62.7 | 63.5 | 63.6 | 58.2 | 53.5 | 49.6 | 43.6 | 47.4 | 6.5 | 2.0 | 1.5 | 0.5 | 0.0 |
| 7.5Ni | 54.4 | 61.4 | 62.4 | 62.4 | 57.0 | 52.6 | 50.2 | 44.6 | 50.3 | 7.5 | | | | |
| 8.5Ni | 51.3 | 59.8 | 60.8 | 61.6 | 55.6 | 51.8 | 49.9 | 44.4 | 53.0 | 8.5 | | | | |
| 10Ni | 39.4 | 55.6 | 58.4 | 59.4 | 53.0 | 49.8 | 49.6 | 44.5 | 55.3 | 10.0 | | | | |
| 0Cr | 59.0 | 60.0 | 60.6 | 60.2 | 56.2 | 45.9 | 37.6 | 30.7 | 48.7 | 7.5 | 0.0 | 1.5 | 0.5 | 0.0 |
| 1Cr | 59.0 | 62.1 | 62.8 | 63.1 | 57.4 | 50.2 | 46.1 | 41.5 | 41.8 | | 1.0 | | | |
| 1.5Cr | 57.7 | 62.6 | 63.2 | 63.6 | 57.5 | 52.6 | 48.7 | 43.2 | 48.6 | | 1.5 | | | |
| 2Cr | 54.4 | 61.4 | 62.4 | 62.6 | 57.0 | 52.6 | 50.2 | 44.6 | 50.3 | | 2.0 | | | |
| 3Cr | 47.1 | 58.7 | 60.5 | 61.0 | 55.2 | 53.5 | 51.7 | 44.6 | 48.3 | | 3.0 | | | |
| 5Cr | 30.0 | 52.8 | 56.9 | 58.3 | 52.5 | 52.8 | 55.4 | 43.6 | 45.4 | | 5.0 | | | |
| 7Cr | 21.6 | 49.6 | 54.8 | 55.9 | 50.4 | 51.5 | 55.9 | 41.9 | 43.7 | | 7.0 | | | |
| 9Cr | 24.9 | 46.6 | 52.5 | 53.2 | 48.8 | 48.8 | 52.6 | 39.9 | 42.2 | | 9.0 | | | |
| 11Cr | 20.8 | 33.3 | 44.3 | 47.8 | 43.7 | 42.6 | 46.2 | 40.8 | 42.8 | | 11.0 | | | |
| 0.15Si | 58.5 | 59.9 | 60.5 | 60.8 | 54.9 | 50.2 | 48.4 | 43.8 | 43.6 | 7.5 | 2.0 | 0.15 | 0.5 | 0.0 |
| 1.0Si | 58.5 | 60.8 | 62.1 | 62.1 | 56.2 | 52.5 | 50.8 | 45.3 | 46.8 | | | 1.0 | | |
| 1.5Si | 58.1 | 60.6 | 62.0 | 61.9 | 55.9 | 53.7 | 51.2 | 45.2 | 47.9 | | | 1.5 | | |
| 2.0Si | 59.3 | 60.2 | 61.2 | 61.6 | 56.7 | 54.6 | 52.3 | 45.9 | 47.4 | | | 2.0 | | |
| 2.5Si | 58.8 | 61.2 | 61.9 | 61.9 | 57.0 | 54.6 | 52.1 | 46.8 | 48.0 | | | 2.5 | | |
| 0.4C | 57.0 | 57.7 | 58.0 | 58.3 | 54.1 | 51.9 | 50.9 | 45.4 | 45.2 | 7.5 | 2.0 | 1.5 | 0.4 | 0.5 |
| 0.5C | 59.2 | 61.9 | 62.6 | 62.6 | 57.3 | 54.7 | 53.2 | 47.4 | 48.0 | | | | 0.5 | 0.5 |
| 0.6C | 59.4 | 62.5 | 63.6 | 63.6 | 58.3 | 55.2 | 53.7 | 47.9 | 48.9 | | | | 0.6 | 0.2 |
| 0.65C | 54.5 | 61.2 | 62.5 | 63.0 | 57.6 | 54.4 | 53.9 | 48.6 | 51.0 | | | | 0.65 | 0.5 |
| 0.8C | 44.1 | 59.2 | 61.3 | 62.0 | 56.7 | 53.8 | 54.8 | 49.3 | 53.4 | | | | 0.8 | 0.5 |
| 0.2V | 59.4 | 62.5 | 63.6 | 63.6 | 58.3 | 55.2 | 53.7 | 47.9 | 48.9 | 7.5 | 2.0 | 1.5 | 0.6 | 0.2 |
| 0.3V | 58.7 | 61.4 | 62.4 | 62.7 | 57.1 | 54.9 | 52.9 | 45.9 | 45.9 | 8.0 | | | 0.5 | 0.3 |
| 0.5V | 59.2 | 61.9 | 62.6 | 62.6 | 57.3 | 54.7 | 53.2 | 47.4 | 48.0 | 7.5 | | | 0.5 | 0.5 |

Figure 2:
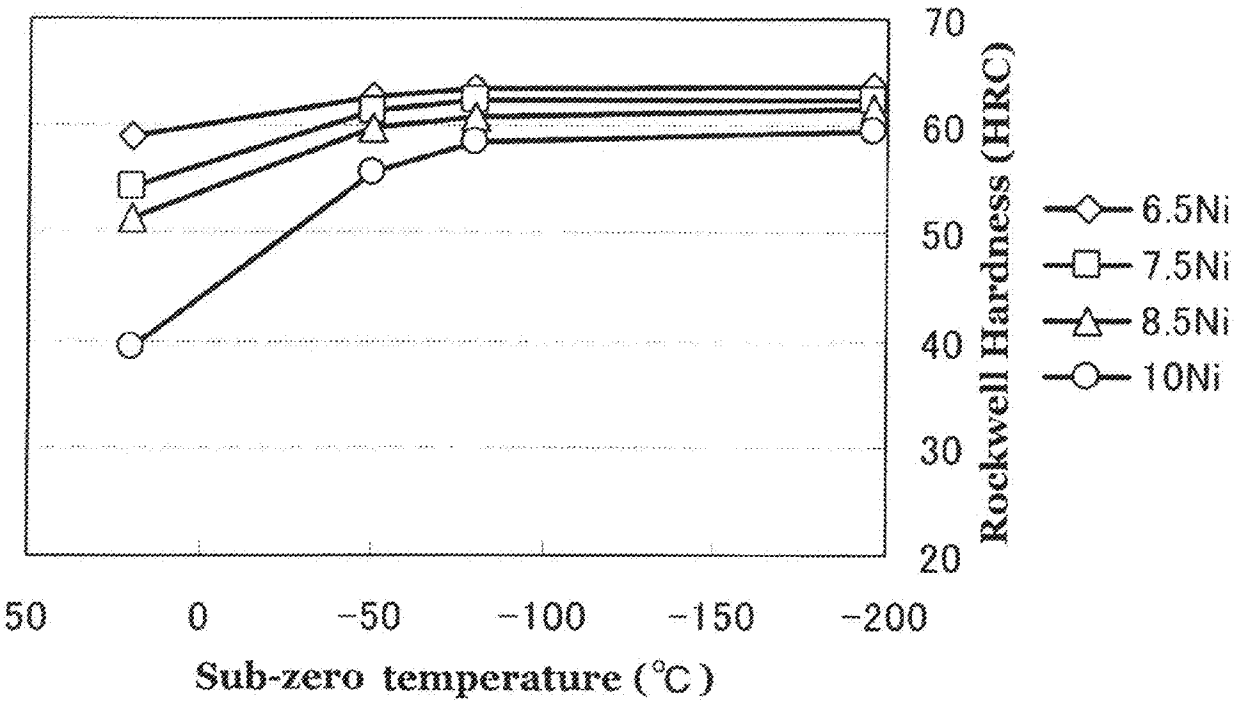

FIG. 2 is a graph showing a relationship between the sub-zero treatment temperature and the hardness in a case wherein chromium, Cr, of 2.0 mass %, silicon, Si, of 1.5 mass %, carbon, C, of 0.5 mass % and vanadium, V, of 0.0 mass % were fixed, while nickel, Ni, of 6.5 mass % (graph with white rhombuses), nickel, Ni, of 7.5 mass % (graph with □; hereinafter, abbreviated as "graph □"), nickel, Ni, of 8.5 mass % (graph Δ) and nickel, Ni, of 10.0 mass % (graph ○) were employed.

Figure 3:
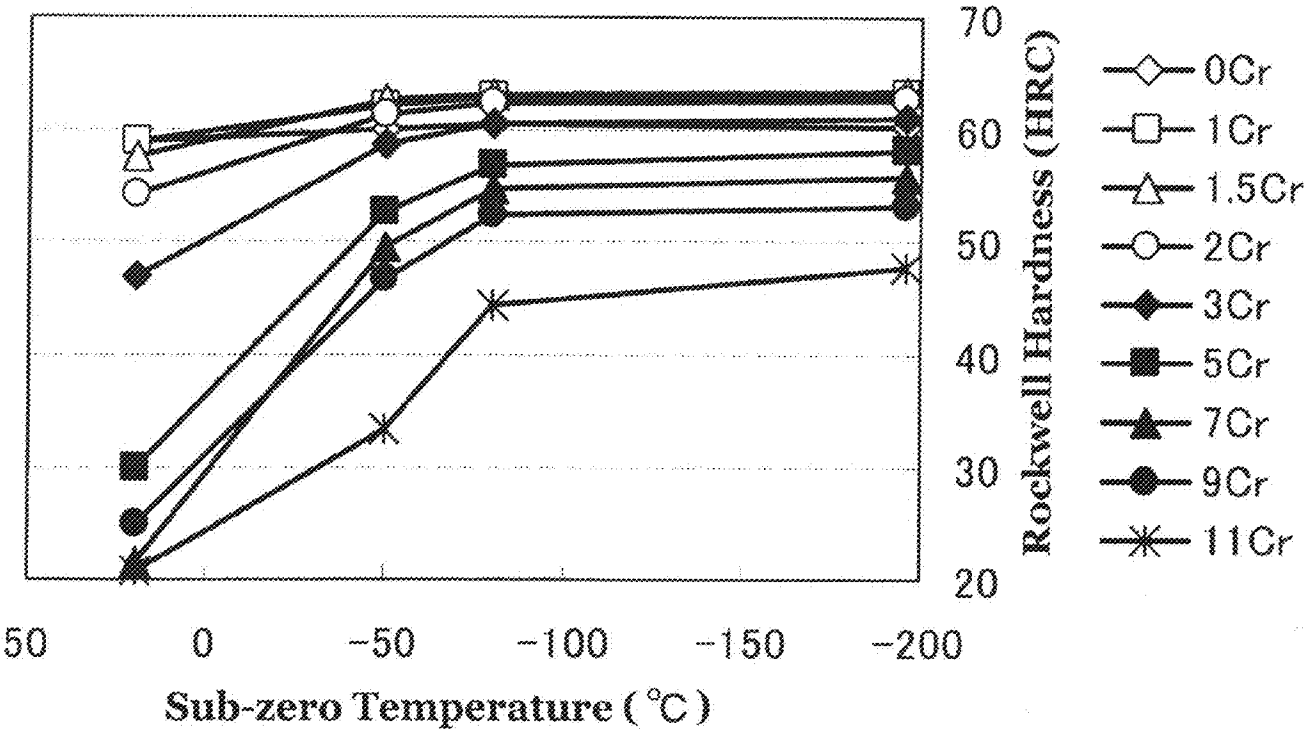

FIG. 3 is a graph showing a relationship between the sub-zero treatment temperature and the hardness in a case wherein nickel, Ni, of 7.5 mass %, silicon, Si, of 1.5 mass %, carbon, C, of 0.5 mass %, vanadium, V, of 0.0 mass % were fixed, while chromium, Cr, of 0.0 mass % (graph with white rhombuses), chromium, Cr, of 1.0 mass % (graph □), chromium, Cr, of 1.5 mass % (graph Δ), chromium, Cr, of 2.0 mass % (graph ○), chromium, Cr, of 3.0 mass % (graph with black rhombuses), chromium, Cr, of 5.0 mass % (graph ■), chromium, Cr, of 7.0 mass % (graph ▲), chromium, Cr, of 9.0 mass % (graph ●) and chromium, Cr, of 11.0 mass % (graph with asterisk-like marks) were employed.

Figure 4:
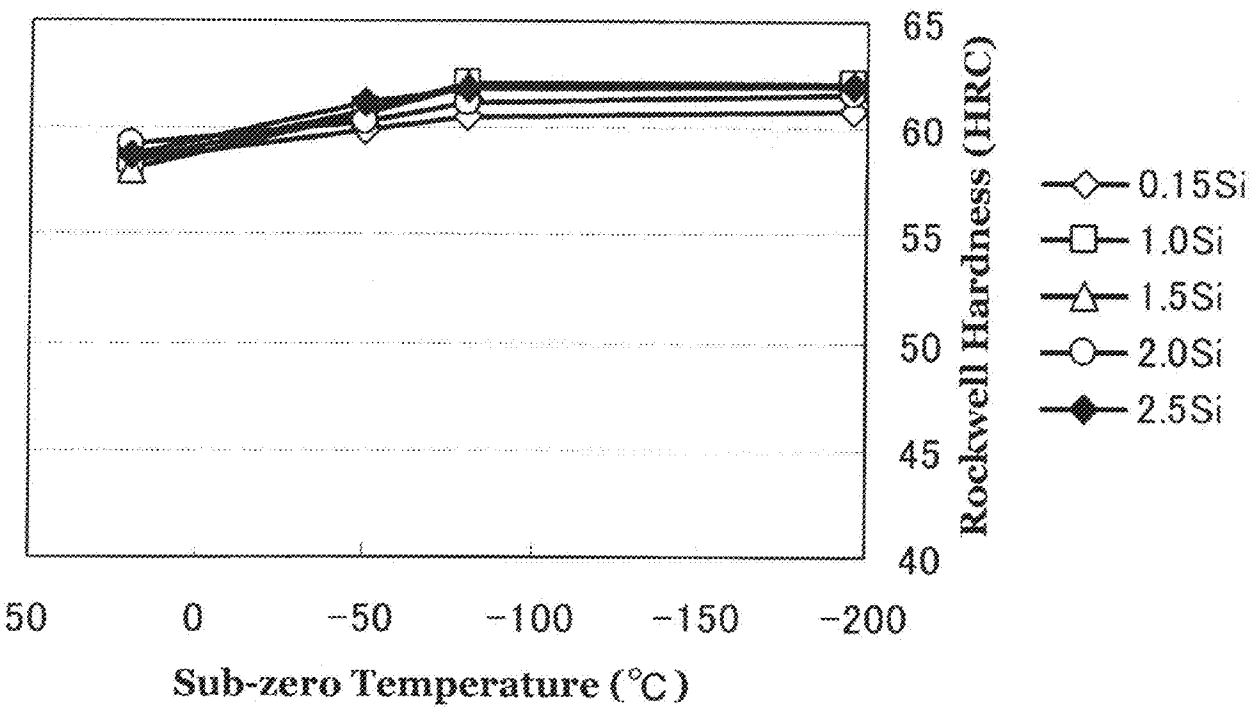

FIG. 4 is a graph showing a relationship between the sub-zero treatment temperature and the hardness in a case wherein nickel, Ni, of 7.5 mass %, chromium, Cr, of 2.0 mass %, carbon, C, of 0.5 mass % and vanadium, V, of 0.0 mass % were fixed, while silicon, Si, of 0.15 mass % (graph with white rhombuses), silicon, Si, of 1.0 mass % (graph □), silicon, Si, of 1.5 mass % (graph Δ), silicon, Si, of 2.0 mass % (graph ○) and silicon, Si, of 2.5 mass % (graph with black rhombuses) were employed.

Figure 5:
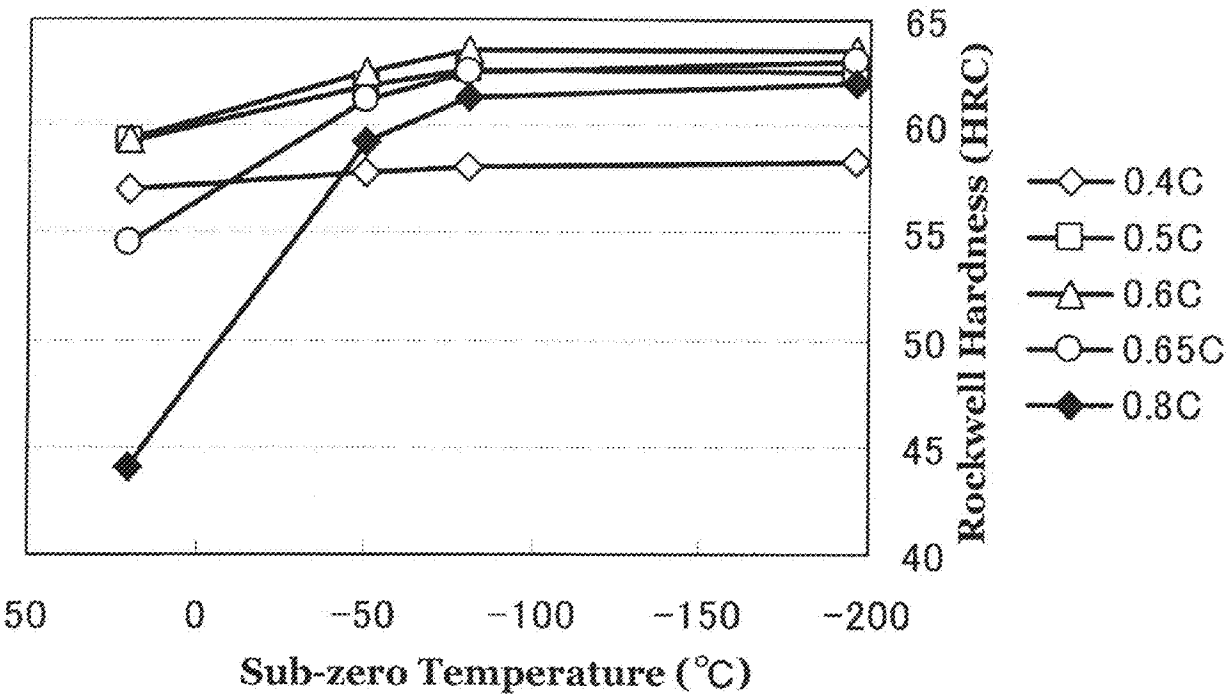

FIG. 5 is a graph showing a relationship between the sub-zero treatment temperature and the hardness in a case wherein nickel, Ni, of 7.5 mass %, chromium, Cr, of 2.0 mass % and silicon, Si, of 1.5 mass % were fixed, while carbon, C, of 0.4 mass % that contains vanadium, V, of 0.5 mass % (graph with white rhombuses), carbon, C, of 0.5 mass % that contains vanadium, V, of 0.5 mass % (graph □), carbon, C, of 0.6 mass % that contains vanadium, V, of 0.2 mass % (graph Δ), carbon, C, of 0.65 mass % that contains vanadium, V, of 0.5 mass % (graph ○), and carbon, C, of 0.8 mass % that contains vanadium, V, of 0.5 mass % (graph with black rhombuses) were employed.

Figure 6:
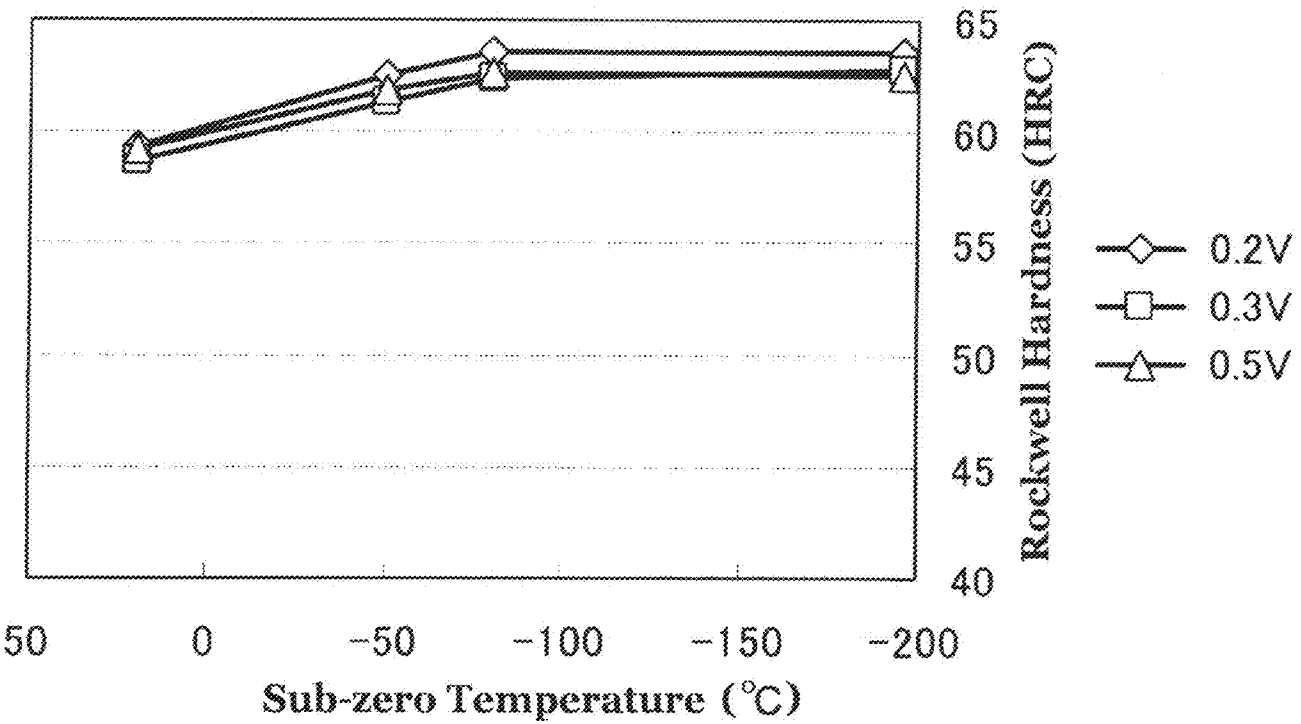

FIG. 6 is a graph showing a relationship between the sub-zero treatment temperature and the hardness in a case wherein chromium, Cr, of 2.0 mass % and silicon, Si, of 1.5 mass % were fixed, while vanadium, V, of 0.2 mass % that contains nickel, Ni, of 7.5 mass % and carbon, C, of 0.6 mass % (graph with white rhombuses), vanadium, V, of 0.3 mass % that contains nickel, Ni, of 8.0 mass % and carbon, C, of 0.5 mass % (graph □), and vanadium, V, of 0.5 mass % that contains nickel, Ni, of 7.5 mass % and carbon, C, of 0.5 mass % (graph Δ) were employed.

Figure 7:
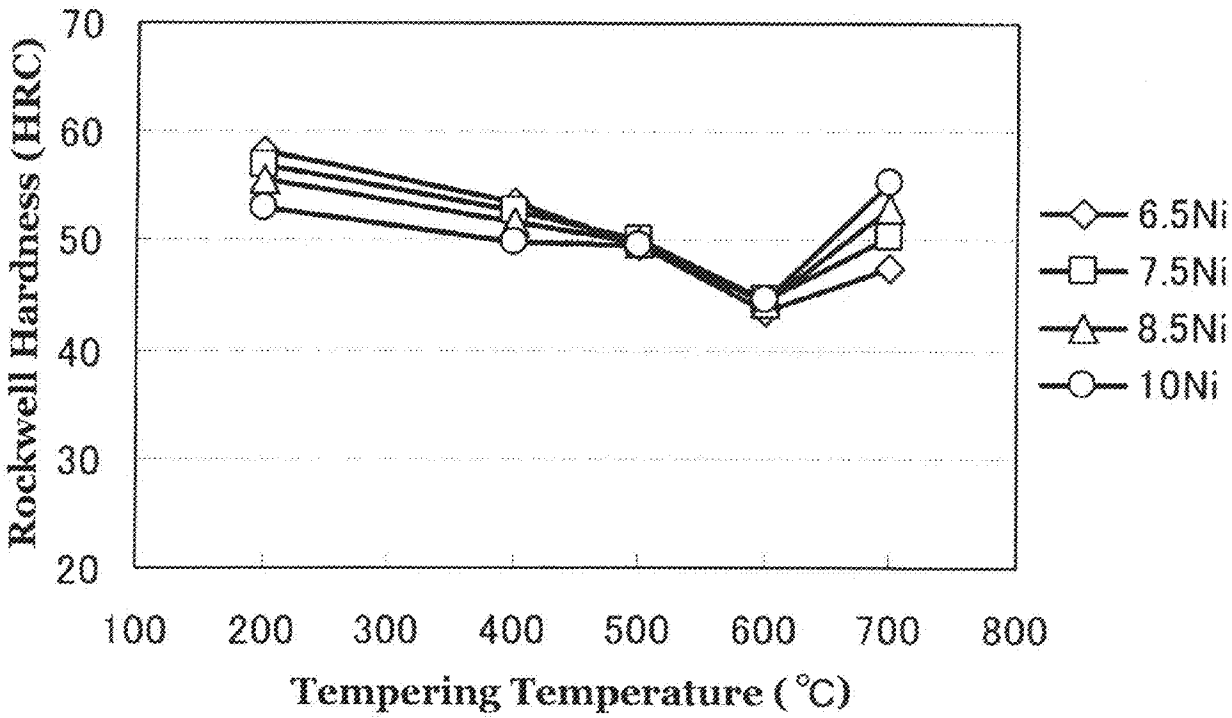

FIG. 7 is a graph showing a relationship between the tempering temperature and the hardness in a case wherein chromium, Cr, of 2.0 mass %, silicon, Si, of 1.5 mass %, carbon, C, of 0.5 mass % and vanadium, V, of 0.0 mass % were fixed, while nickel, Ni, of 6.5 mass % (graph with white rhombuses), nickel, Ni, of 7.5 mass % (graph □), nickel, Ni, of 8.5 mass % (graph Δ) and nickel, Ni, of 10.0 mass % (graph ○) were employed. For these cast steel materials, the sub-zero treatment at −80° C. was performed prior to the tempering process.

Figure 8:
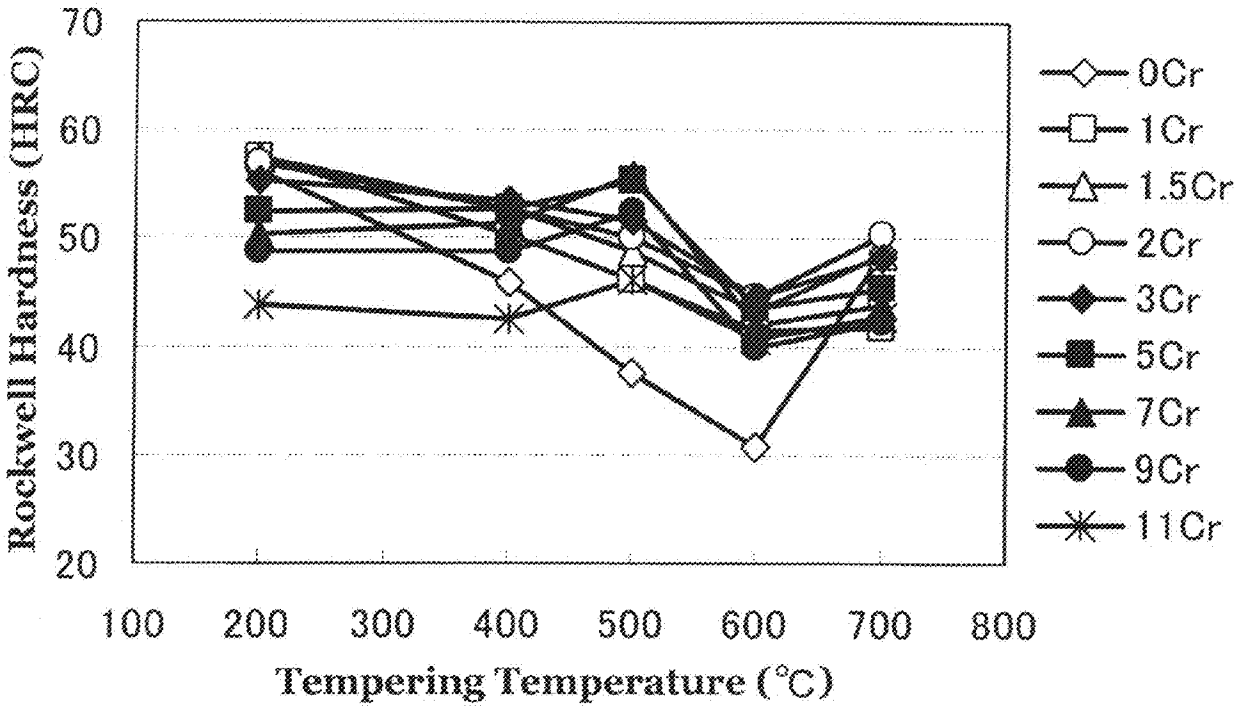

FIG. 8 is a graph showing a relationship between the tempering temperature and the hardness in a case wherein nickel, Ni, of 7.5 mass %, silicon, Si, of 1.5 mass %, carbon, C, of 0.5 mass %, vanadium, V, of 0.0 mass % were fixed, while chromium, Cr, of 0.0 mass % (graph with white rhombuses), chromium, Cr, of 1.0 mass % (graph □), chromium, Cr, of 1.5 mass % (graph Δ), chromium, Cr, of 2.0 mass % (graph ○), chromium, Cr, of 3.0 mass % (graph with black rhombuses), chromium, Cr, of 5.0 mass % (graph ■), chromium, Cr, of 7.0 mass % (graph ▲), chromium, Cr, of 9.0 mass % (graph ●) and chromium, Cr, of 11.0 mass % (graph with asterisk-like marks) were employed. For these cast steel materials, the sub-zero treatment at −80° C. was performed prior to the tempering process.

Figure 9:
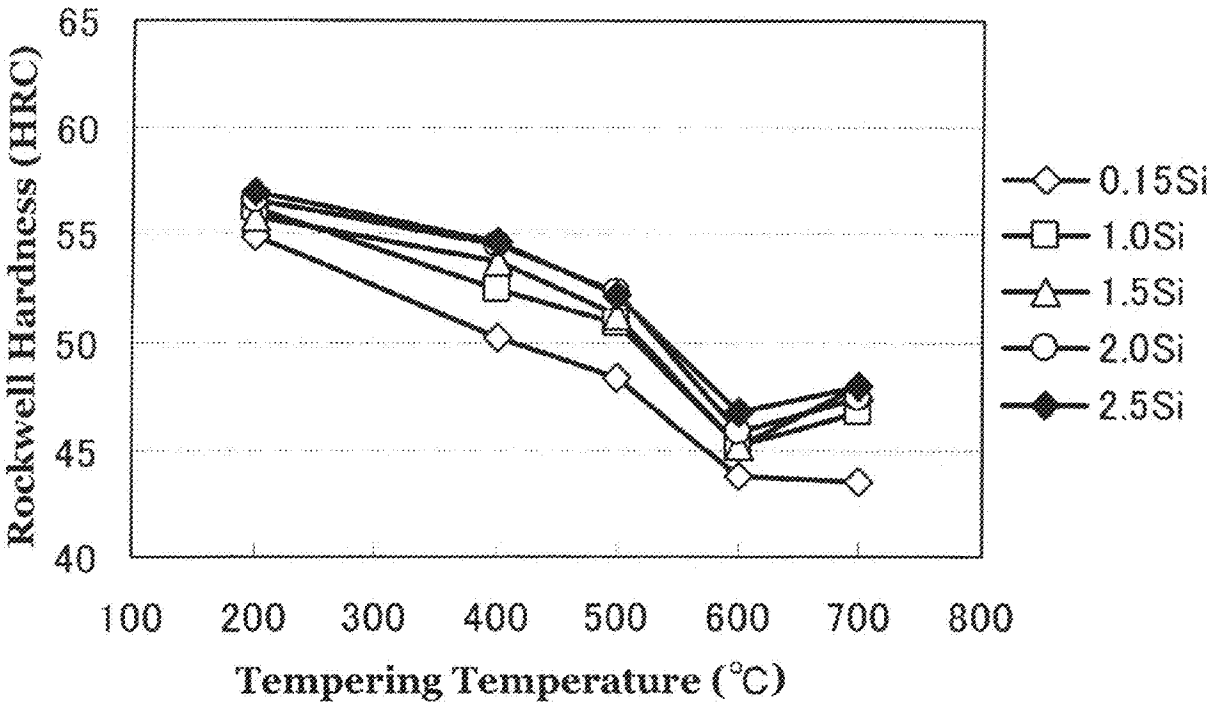

FIG. 9 is a graph showing a relationship between the tempering temperature and the hardness in a case wherein nickel, Ni, of 7.5 mass %, chromium, Cr, of 2.0 mass %, carbon, C, of 0.5 mass % and vanadium, V, of 0.0 mass % were fixed, while silicon, Si, of 0.15 mass % (graph with white rhombuses), silicon, Si, of 1.0 mass % (graph □), silicon, Si, of 1.5 mass % (graph Δ), silicon, Si, of 2.0 mass % (graph ○) and silicon, Si, of 2.5 mass % (graph with black rhombuses) were employed. For these cast steel materials, the sub-zero treatment at −80° C. was performed prior to the tempering process.

Figure 10:
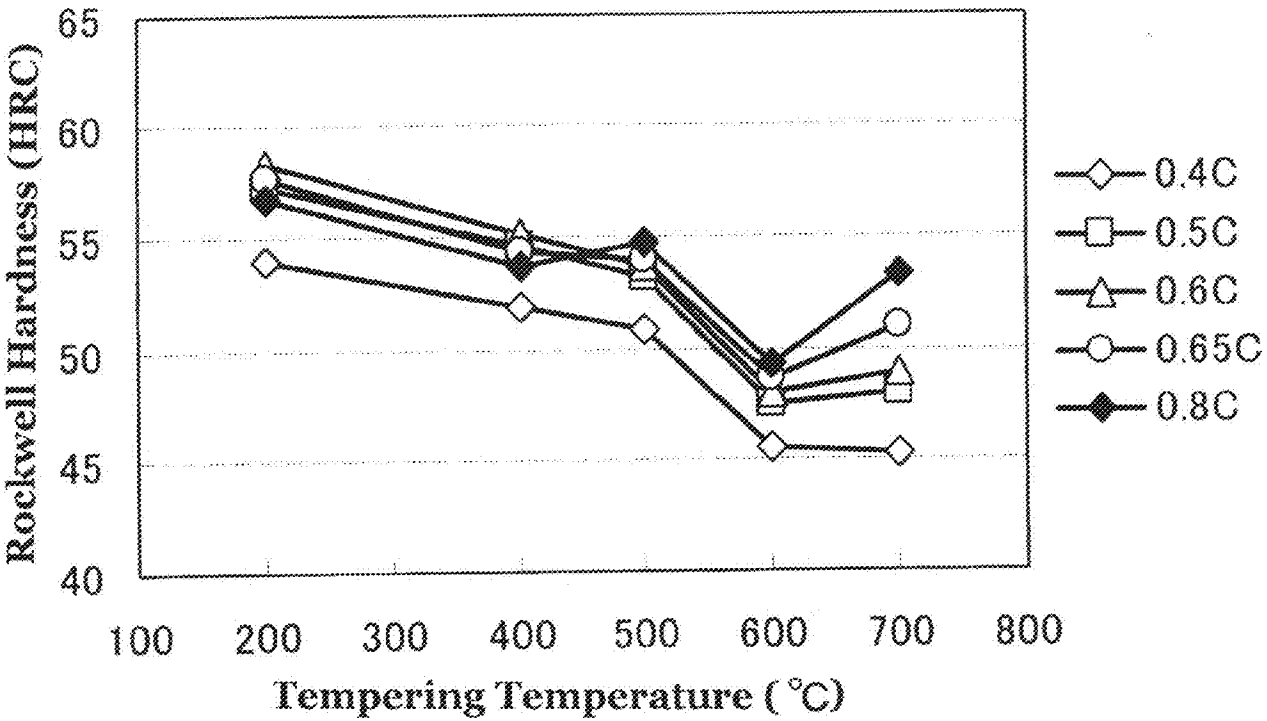

FIG. 10 is a graph showing a relationship between the tempering temperature and the hardness in a case wherein nickel, Ni, of 7.5 mass %, chromium, Cr, of 2.0 mass % and silicon, Si, of 1.5 mass % were fixed, while carbon, C, of 0.4 mass % that contains vanadium, V, of 0.5 mass % (graph with white rhombuses), carbon, C, of 0.5 mass % that contains vanadium, V, of 0.5 mass % (graph □), carbon, C, of 0.6 mass % that contains vanadium, V, of 0.2 mass % (graph Δ), carbon, C, of 0.65 mass % that contains vanadium, V, of 0.5 mass % (graph ○), and carbon, C, of 0.8 mass % that contains vanadium, V, of 0.5 mass % (graph with black rhombuses) were employed. For these cast steel materials, the sub-zero treatment at −80° C. was performed prior to the tempering process.

Figure 11:
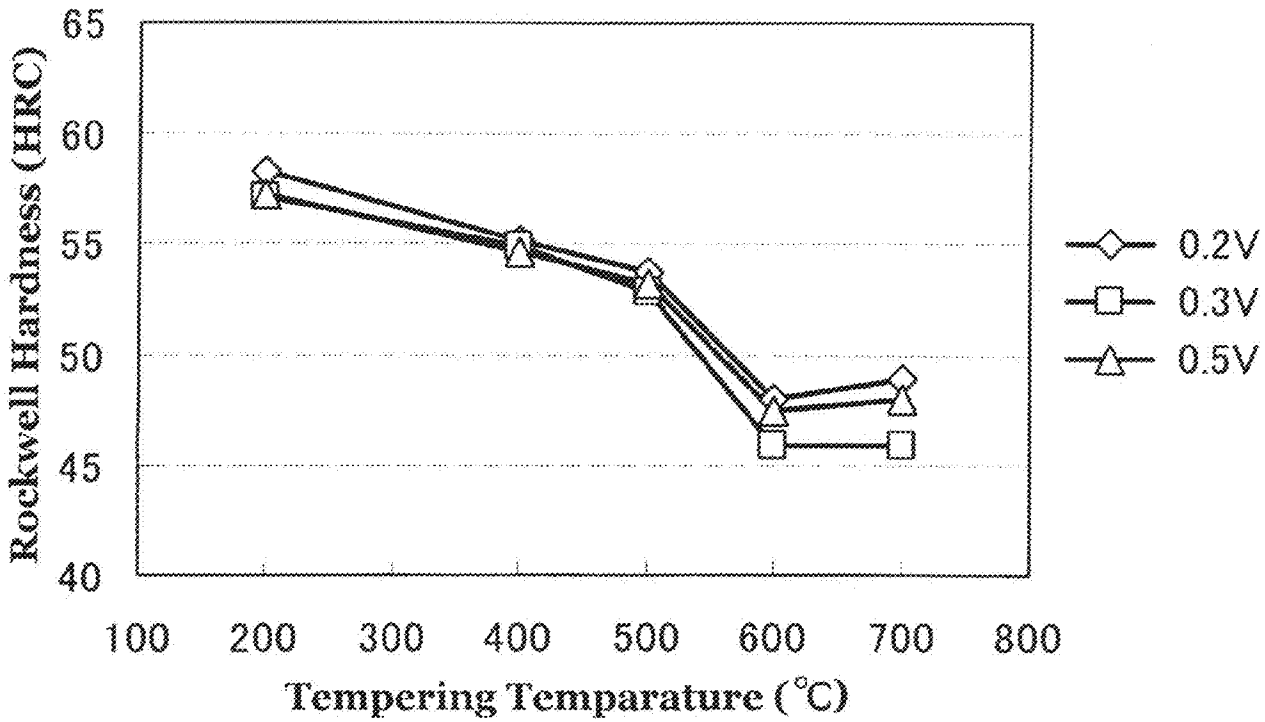

FIG. 11 is a graph showing a relationship between the tempering temperature and the hardness in a case wherein chromium, Cr, of 2.0 mass % and silicon, Si, of 1.5 mass % were fixed, while vanadium, V, of 0.2 mass % that contains nickel, Ni, of 7.5 mass % and carbon, C, of 0.6 mass % (graph with white rhombuses), vanadium, V, of 0.3 mass % that contains nickel, Ni, of 8.0 mass % and carbon, C, of 0.5 mass % (graph □), and vanadium, V, of 0.5 mass % that contains nickel, Ni, of 7.5 mass % and carbon, C, of 0.5 massa (graph Δ) were employed. For these cast steel materials, the sub-zero treatment was performed prior to the tempering process.

Figure 12:
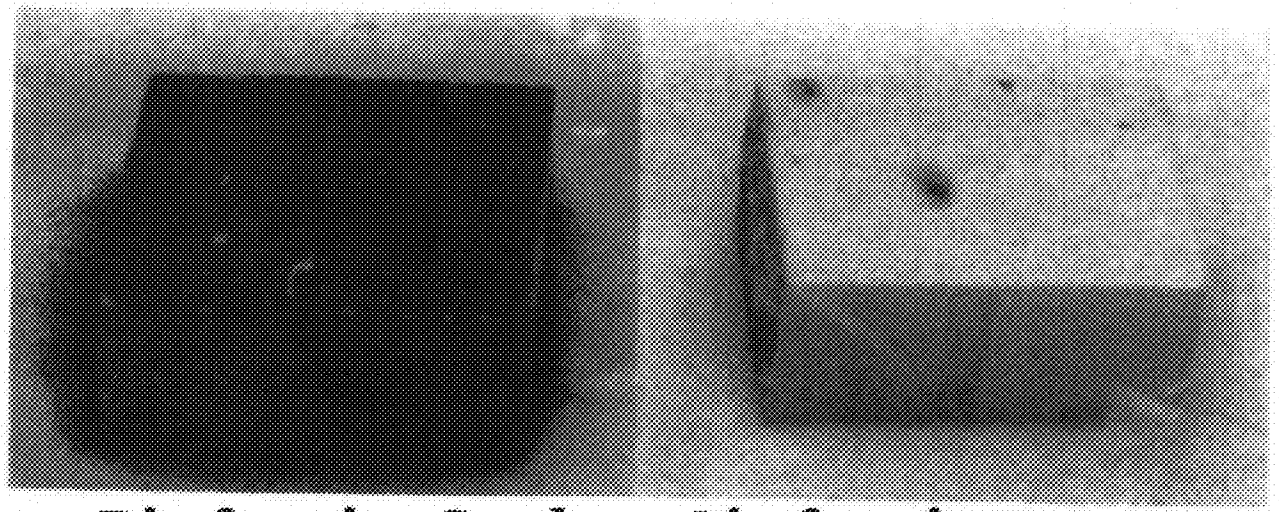

In order to verify the superiority of the martensitic cast steel material of the present invention, the same condition was employed to compare this martensitic cast steel material with commercially available materials that are employed for almost the same purposes. Photographs in FIG. 12 show the exterior appearances of the commercially available die-forming steel material A (Ni—Cu—Al type) (A in the drawing) and the commercially available die-forming stainless steel material B (13% Cr type) (B in the drawing) obtained after these materials were immersed in a stream of tap water for 100 hours. A slight layer of rust, derived from attached substances, is observed on the die-forming stainless steel material B, while rusting is observed across the entire surface of the die-forming steel material A.

Figure 13:
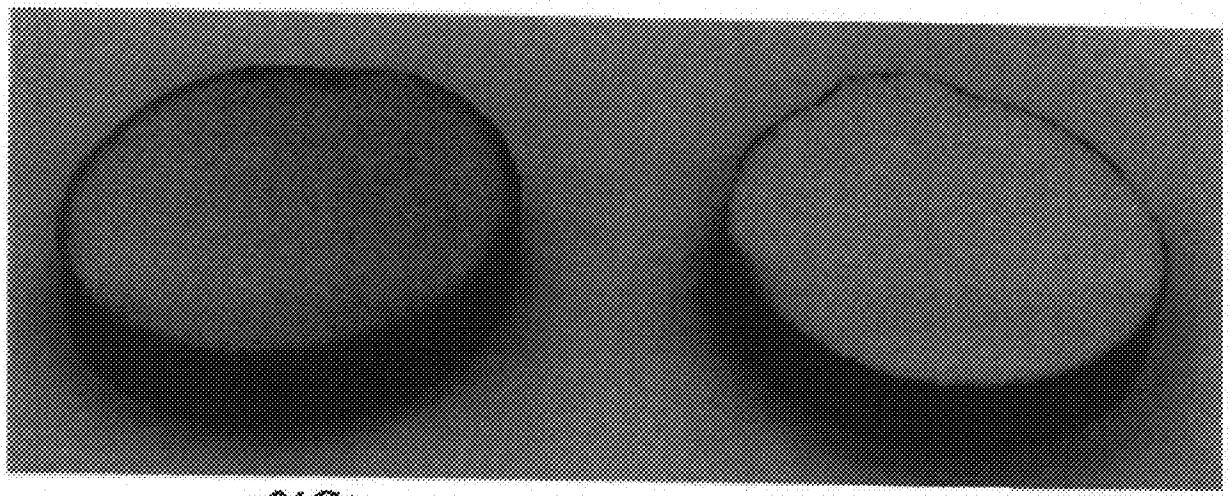

FIG. 13 is a photograph showing the surfaces of samples of the martensitic cast steel material according to the present invention. Specifically, martensitic cast steel materials were prepared by melting, so that the composition of (A) included chromium, Cr, of 2.0 mass % and the composition of (B) included chromium, Cr, of 3.0 mass %, while nickel, Ni, of 7.5 mass %, silicon, Si, of 1.5 mass %, carbon, C, of 0.5 mass % and vanadium, V, of 0.0 mass % were fixed, and the sub-zero treatment at −80° C. was performed for the materials. Thereafter, the steel materials were cut, and the obtained samples were immersed in a stream of tap water for 100 hours, so that the surfaces in the photograph were obtained. Rusting occurred on the side faces where an oxide layer was generated during the casting process, but there was no rust on the center of the cast steel materials. Therefore, the martensitic cast steel material of this invention, which contains chromium, Cr, has a satisfactory corrosion resistance equivalent to the die-forming stainless steel material B, which has been regarded as having superior corrosion resistance.

Figure 14:
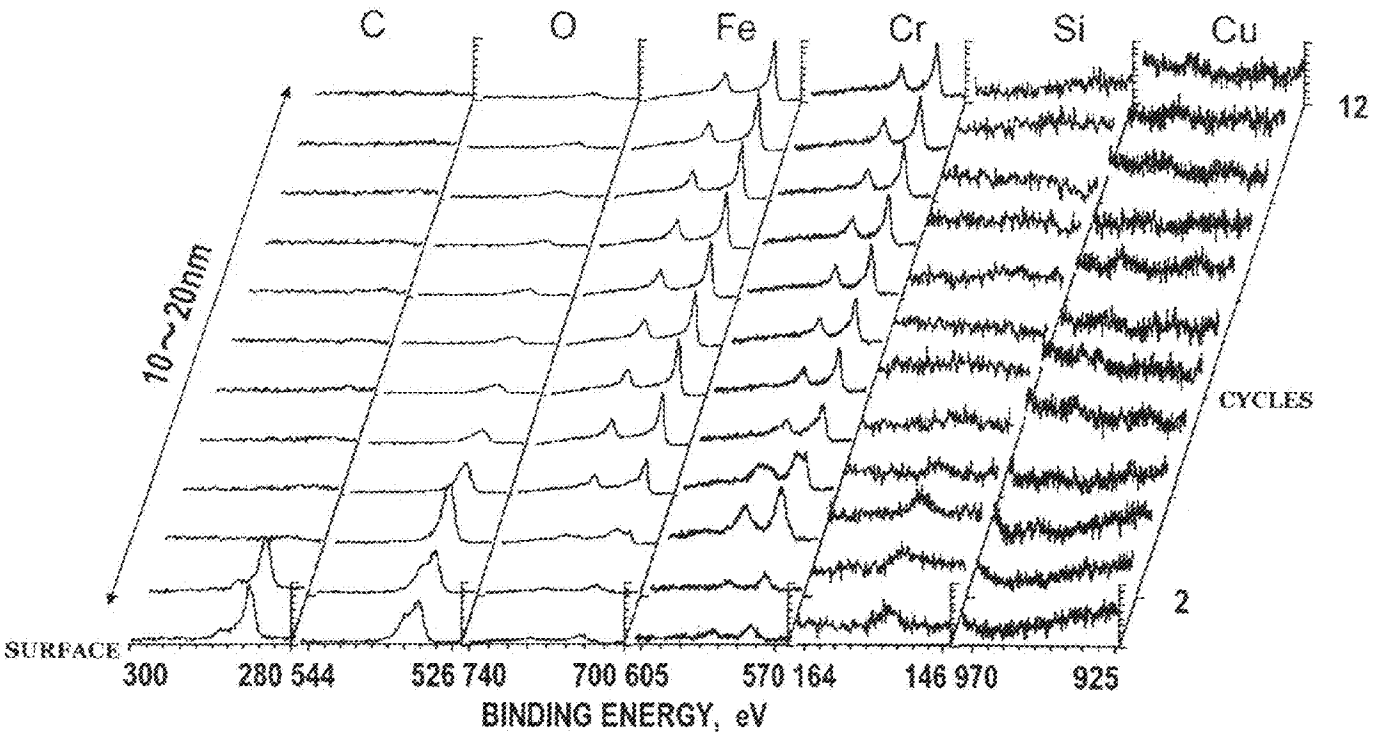

For comparison with the properties of the martensitic cast steel material of the present invention, X-ray photoelectron spectroscopy (XPS or ESCA) was performed for the oxide film that was formed on the die-forming stainless steel material B, which is a commercially available material, and the following results were obtained. FIG. 14 is an output diagram showing carbon, C, oxygen, O, iron, Fe, chromium, Cr, silicon, Si, and copper, Cu, which are the analysis results obtained using XPS, for the surface of the die-forming stainless steel material B that was repetitively etched, in a direction toward the center, by argon (Ar) ion sputtering. It was observed that a chromium (Cr) oxide that exhibits preferable corrosion resistance was formed on the surface layer.

Figure 15:
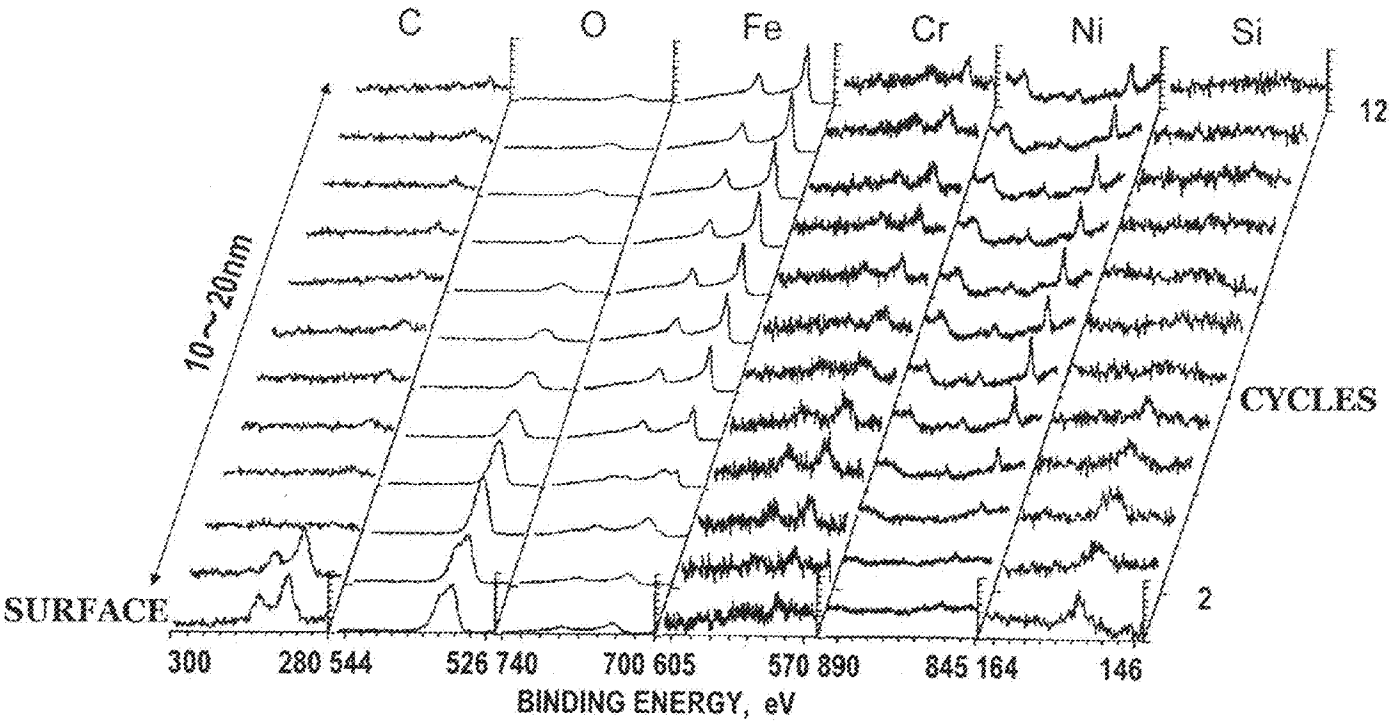

When oxide film formed on the surface of the martensitic cast steel material of the present invention was observed, the following results were obtained. FIG. 15 is an output diagram showing carbon, C, oxygen; O, iron, Fe, chromium, Cr, nickel, Ni, and silicon, Si, that are the results obtained by analyzing, using XPS, the surface of the cast steel material, which was prepared by melting so as to contain nickel, Ni, of 7.5 mass %, chromium, Cr, of 2.0 mass %, silicon, Si, of 1.5 mass %, carbon, C, of 0.5 mass % and vanadium, V, of 0.0 mass %, and for which the sub-zero treatment at −80° C. was performed first, and then etching was repetitively performed toward the center by argon (Ar) ion sputtering. Like the die-forming stainless steel material B described above, it was observed that chromium, Cr, oxide having preferable corrosion resistance was formed on the surface layer. When the results in FIGS. 14 and 15 were compared, it was understood that the film formed on the die-forming stainless steel material B to exhibit preferable corrosion resistance is also formed on the martensitic cast steel material of this invention, to which chromium, Cr, of 2 mass % was added.

Figure 16:
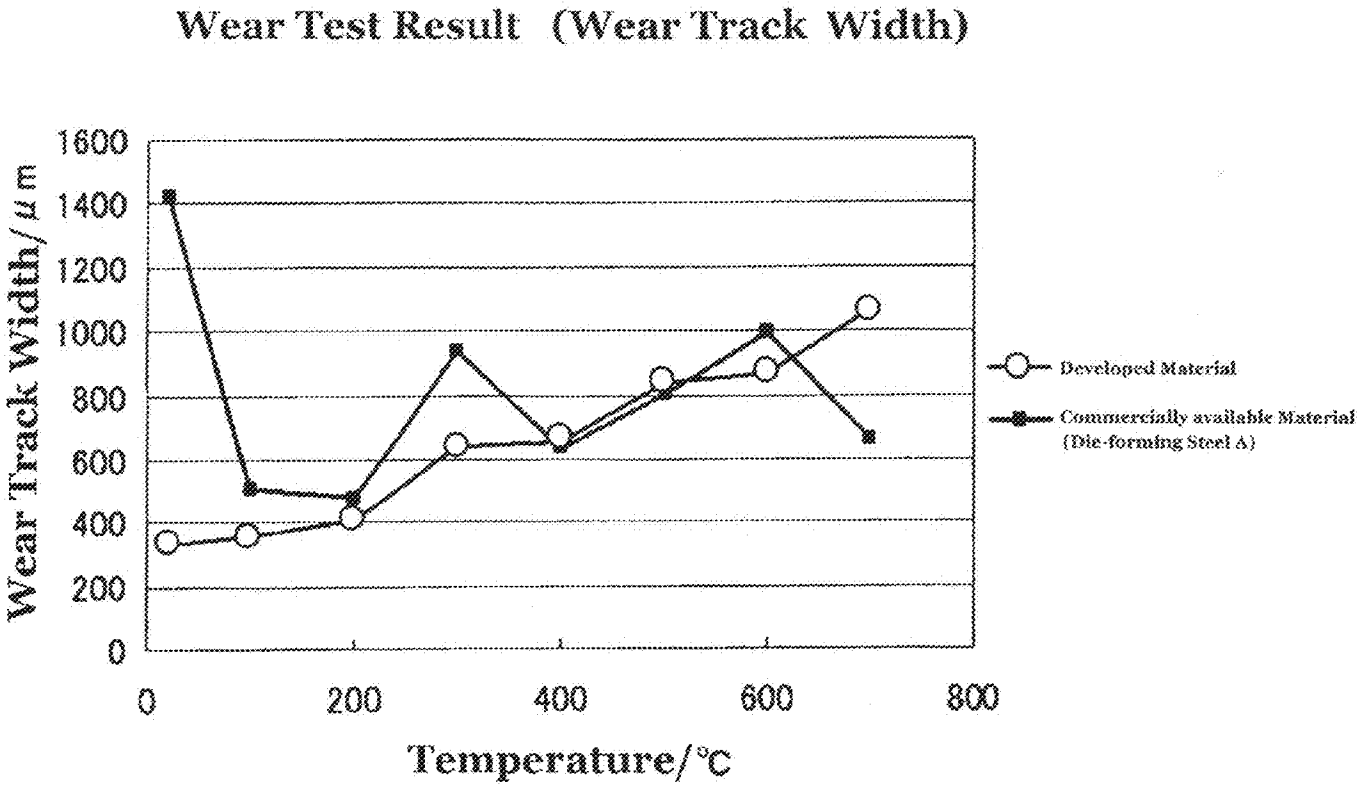

Further, a wear test using a ball-on-disk tribometer was conducted to examine the wear resistance of the martensitic cast steel material of the present invention. The cast steel sample (developed material) was prepared by melting, so that the contents of the individual elements were nickel, Ni, of 7.5 mass %, chromium, Cr, of 2.0 mass %, silicon, Si, of 1.5 mass %, carbon, C, of 0.5 mass % and vanadium, V, of 0.0 mass %, and thereafter, the sub-zero treatment at −80° C. and the tempering process at 600° C. were performed for the sample. As a comparison item, the die-forming steel material A described above was employed, and the same wear test was conducted. FIG. 16 is a graph showing the measurement results in a temperature range from the normal temperature to about 700° C., while the width of a wear track (unit of μm) formed on the surfaces of both samples is employed as the vertical axis, and a temperature change is employed as the horizontal axis. Based on the test results, it was confirmed that wear resistance was superior from a normal temperature range to 400° C. so that the width of a wear track was narrowed, and almost the same wear resistance was still maintained in a high temperature range of up to about 600° C.

Figure 17:
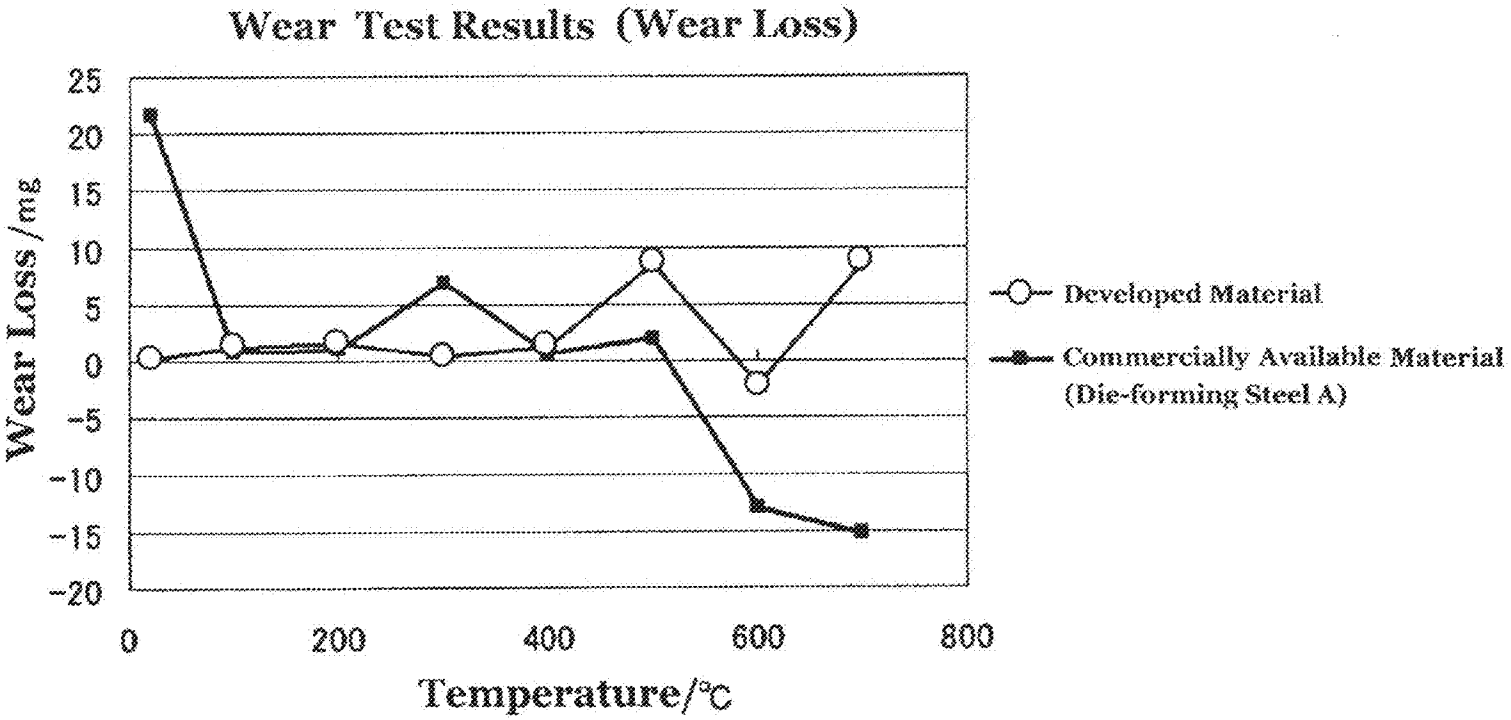

FIG. 17 is a graph showing the results, i.e., wear losses [mg], measured by conducting, for comparison, a ball-on-disk wear test for the die-forming steel material A and the cast steel sample (developed material) of this invention, while the vertical axis represents an wear loss and the horizontal axis represents a temperature. It was apparent from the test results that the wear loss of the tested cast steel material was small at temperatures ranging from normal to 400° C. Based on these test results, it was confirmed that the martensitic cast steel material of this invention is, in part, superior to the commercially available die-forming steel material A, and is still stable in a high temperature range of about 500° C. or higher.

Figure 18:
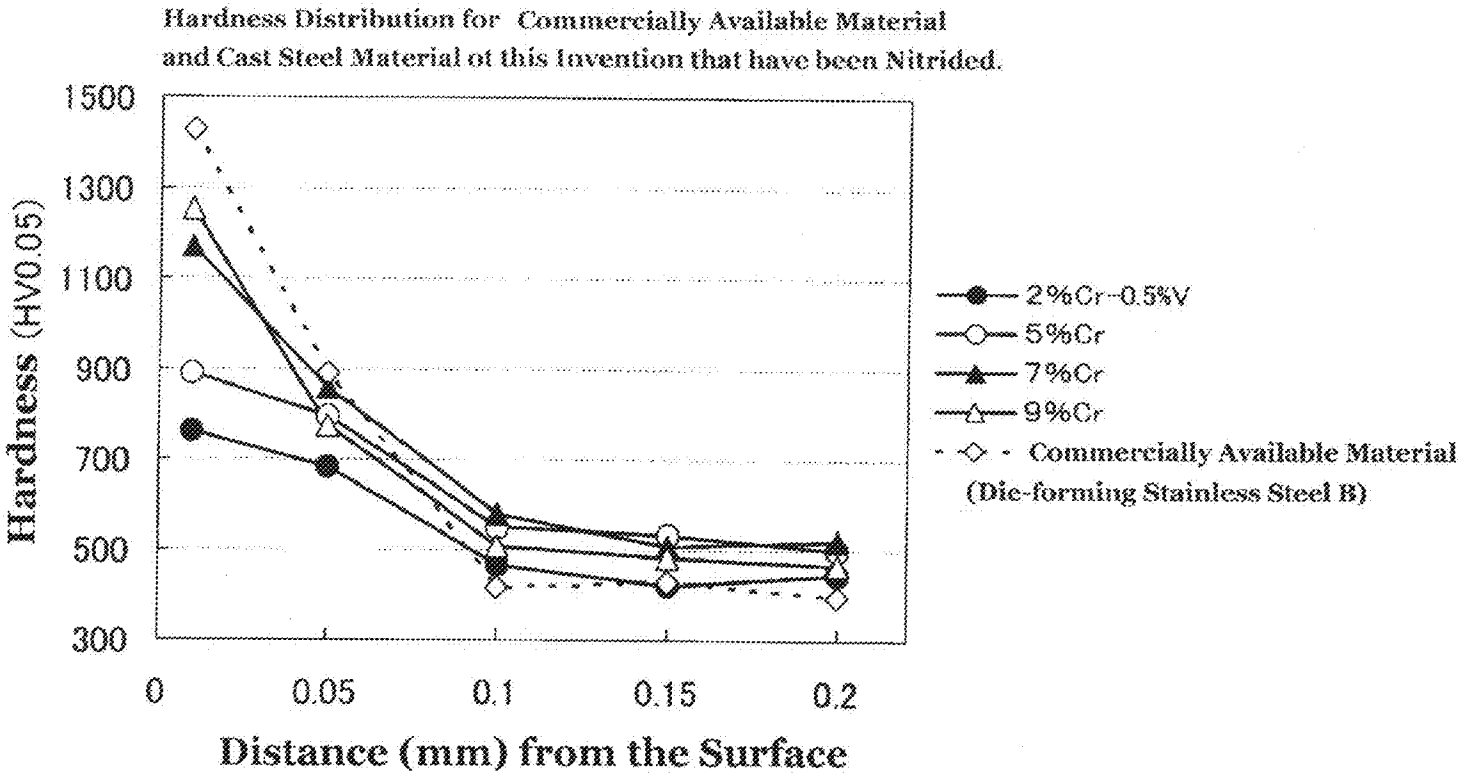

FIG. 18 is a graph showing a relationship of hardness distributions between the martensitic cast steel materials (nitrided) of the present invention and the commercially available die-forming stainless steel material B, when the hardness (HV 0.05) is employed as the vertical axis and the distance (mm) from the surface is employed as the horizontal axis. For the compositions of the cast steel materials of the present invention, chromium, Cr, of 2.0 mass % (graph ●), chromium, Cr, of 5 mass % (graph ○), chromium, Cr, of 7 mass % (graph ▲) and chromium, Cr, of 9 mass % (graph Δ) were employed, while nickel, Ni, of 7.5 mass %, silicon, Si, of 1.5 mass %, carbon, C, of 0.5 mass % and vanadium, V, of 0.5 mass % were fixed, and the hardness distributions for the cases wherein the nitriding process was performed for the individual cast steel materials are shown.

As is apparent from this graph, it was confirmed that the martensitic cast steel materials of this invention (nitrided under the following conditions) obtained a surface hardness that was slightly lower than that of the commercially available stainless steel material B, but was still satisfactorily high for practical use. It should be noted that the sub-zero treatment at −80° C. was performed in advance for the martensitic cast steel material of the present invention, and the resultant cast steel material was placed in an atmosphere controlled vacuum chamber, with the die-forming steel material, which is a commercially available material, and while the atmosphere in the furnace was maintained at a gas mixture ratio of nitrogen $N_2$: hydrogen $H_2$=1:1 and at a gas pressure of 798 Pa (6 Torr), the surface treatment for application of a predetermined voltage, i.e., the ion-nitriding process for heating and ion injection by glow discharge, was performed at 520° C. for three hours.

EXAMPLE 1

Locating Pin Used for Steel Sheet Stamping

For pressing a thick steel sheet to produce a large item, such as an automobile body, locating pins are indispensable for positioning and fixing a steel sheet in advance. The hardness of HRC 45 to 55 is required for a locating pin. Also, for a locating pin, corrosion resistance is required to defeat the corrosive effects of the application of a jet steam of water, which is employed to remove dirt, such as steel powder generated by pressing, from the locating pin.

Conventionally, in order to obtain a locating pin that satisfies requested functions, a steel material that has been machined is hardened and tempered, and thereafter, the surface treatment is performed for the resultant steel material to provide corrosion resistance and wear resistance. However, according to the present invention, since the near-net shaping process is employed for manufacturing a martensitic cast steel material, the machining process is facilitated, the quenching process performed for hardening is not required, and simply the sub-zero treatment need be performed. Further, not only corrosion resistance and wear resistance can be provided for the martensitic cast steel material of this invention, but also the surface can be further hardened by performing the tempering process in a nitrogen atmosphere, so that manufacturing costs can be greatly reduced, compared with those for a conventional product.

EXAMPLE 2

Superior Corrosion Resistant, Temperature-Control Die with Heat Exchanging Tube for Plastic Molding A molding die for plastic injection can be obtained by performing, for the martensitic cast steel material of the present invention, the so-called near-net shaping process, for which casting is performed using a mold that provides a shape near that of a desired shape for a final product. It is known that so long as a temperature control for this type of mold is enabled, within a desired range, the surface property of a product can be greatly improved. For temperature control, generally, water or heating medium oil is circulated by an external temperature controller, passing through a temperature-control tube that is provided inside a mold. However, when a conventional steel material is used to manufacture a mold, a temperature-control tube must be formed by performing the so-called post-process, i.e., by externally drilling through the obtained mold. Thus, only a linear temperature-control tube is formed, and a temperature-control tube having an arbitrary shape can not be obtained in order to precisely control temperature along a cavity, and temperature unevenness can not be appropriately eliminated.

Furthermore, the material of a die used for plastic molding should also be corrosion resistant to a pyrolysis gas, which is generated when a plastic material is melted at a high temperature. For a die for molding, for example, a resin that has a comparatively high melting point, such that a melting temperature in a molding process is 300° C. or higher, a resin that generates corrosive gas when melting, or a resin for which the melting temperature and the temperature for pyrolysis are near each other, a die-forming steel material must be employed that is superior in corrosion resistance, as well as mechanical properties, such as strength and fracture toughness, and machinability, such as surface property and machining accuracy.

By contrast, as for the martensitic cast steel material of the present invention, casting is performed together with a metal tube arranged in the mold, so that an arbitrarily shaped temperature-control tube can be formed, and as a result, an injection molding die can be obtained, without temperature unevenness in the cavity. Further, when the cast steel material of the invention is employed, the obtained injection molding die has corrosion resistance equivalent to, or higher than, when a commercially available die-forming steel material having superior corrosion resistance is employed as a die material. In this example, molten metal (Ni of 7.5 mass %, Cr of 2 mass %, Si of 1.5 mass %, and C of 0.5 mass %) is poured into a mold wherein a temperature-control tube, bent into a desired shape, is located, and the injection molding die is obtained, wherein the temperature-control tube is embedded at the desired location. Needless to say, a material that will not be damaged or deformed by pouring hot metal around the tube must be selected for the temperature-control tube. In this example, a steel tube, for which the internal structure has a desired shape, or the inner diameter is a desired length, is employed; however, another proper metal tube may be employed while taking the above described conditions into account.

EXAMPLE 3

Aluminum Die Casting Mold Having Superior Oxidation Resistance

An aluminum die casting mold can be obtained by performing, for the martensitic cast steel material of the present invention, the so-called near-net shaping process, during which casting is performed by using a mold that provides a shape near that of a desired shape for a final product. It is known that so long as a temperature control for this type of mold is enabled, within a desired range, the accuracy of dimensions and the productivity of a product, and the service life of a mold can be greatly improved. For temperature control, generally, water or heating medium oil is circulated by an external temperature controller, and passes through a temperature-control tube that is provided inside the mold. However, when a mold is manufactured using conventional steel material, a temperature-control tube must be formed by performing the so-called post-process, i.e., by externally drilling into the obtained mold. Therefore, only a linear temperature-control tube is formed, and an arbitrarily shaped temperature-control tube can not be obtained in order to precisely control the temperature along the cavity, so that a cooling temperature unevenness can not be appropriately eliminated, while a desired temperature is maintained.

In addition to the improvement for the temperature-control tube, multiple attempts for extending the service life of a mold have been made by using a method for employing a die-forming steel material that has superior corrosion resistance and oxidation resistance so as to reduce the reactivity to molten aluminum alloy that is assumed to be at about 700°, or by performing the surface treatment to provide superior corrosion resistance and oxidation resistance. Further, there is a report submitted that, in accordance with the recent progress of the material technology, the temperature control within a desired range not only enables an increase in the productivity, such as the reduction of a cycle time, but also provides a more closely-packed metal structure for an aluminum die cast product, and makes it possible to suppress melting damage, which is a phenomenon where a molten aluminum alloy, which is assumed to be about 700° C., contacts the surface of a mold, and the surface of the mold dissolved into the molten aluminum. Based on this report, a product plan is made for a die-forming steel material, for which twice the thermal conductivity of the conventional die-forming steel material is provided, so that temperature control can be performed within a desired range.

By contrast, as for the martensitic cast steel material of the present invention, casting is performed together with a metal tube arranged in a mold, so that an arbitrary shaped temperature-control tube can be formed, and as a result, an aluminum die cast mold can be obtained, without temperature unevenness in the cavity, while a desired temperature is maintained. Further, when the martensitic cast steel material of the invention is employed, the obtained aluminum die casting mold has as superior a corrosion resistance and an oxidation resistance as a commercially available die-forming steel material, or as provided by the surface treatment. In this example, molten metal (nickel, Ni, of 7.5 mass %, chromium, Cr, of 3 mass %, silicon, Si, of 1.5 mass %, and carbon, C, of 0.5 mass %) is poured into a mold where a temperature-control tube bent into a desired shape is located, and the aluminum die casting mold is obtained, where the temperature-control tube having a desired shape is embedded at the desired location. Needless to say, a material that will not be damaged or deformed by pouring molten aluminum around the tube, must be selected for the temperature-control tube. In this example, a steel tube for which the internal structure has a desired shape, or the inner diameter is a desired length, is employed; however, another proper metal tube may be employed while taking the above described conditions into account.

EXAMPLE 4

Hot Runner Manifold Block

As for the martensitic cast steel material of the present invention, a product having a desired internal structure can be manufactured by arranging a tube having a desired shape in a mold. According to the manufacturing method of this invention, a hot runner manifold block that includes a melted resin channel and a temperature-control tube having a desired shape can be obtained. As a product obtained by plastic molding, there are not only a product portion having a targeted shape, but also unnecessary portions called sprues and runners that were used as channels for melted resin during the injection process. A method for extracting these unnecessary portions, with a product portion, as a solid item, and either recycling or discarding the unnecessary portions is called a cold runner method. With the cold runner die, the shape and the arrangement of a melted resin channel can be selected with a great degree of freedom; however, since unnecessary portions are discarded, coping with the increase in the environmental burden is a problem. As a method for avoiding the generation of such unnecessary portions, a so-called hot runner system is popular that employs a die part that incorporates a mechanism that maintains an entire melted resin channel at the melting temperature of the resin, and separates the melted resin from the product portion. This system is helpful for cost reduction and resource saving in the plastic molding industry.

For the manifold block, which is the main part of the hot runner system, a channel need be machined in a desired shape to suppress a pressure loss that occurs when a viscous melted resin passes along the channel. However, for channel formation using machining, either merely forming a simple shape, such as a basic linear shape, or employing a high manufacturing cost method for bonding a member prepared in a desired shape in advance, must be selected. Further, the hot runner manifold block should be corrosion-resistant in the presence of pyrolysis gas that is generated by melting a plastic material at a high temperature. For example, when a resin material having a comparatively high melting point, such that the melting temperature in the molding process is 300° C. or higher, a resin material that generates corrosive gas while being melted, or a resin material for which the melting temperature and the pyrolysis temperature are near each other, is introduced into a mold, a steel material must be employed that is superior in corrosion resistance, as well as excellent mechanical properties, such as strength and toughness, and machinability, such as surface property and machining accuracy.

By contrast, as for the martensitic cast steel material of this invention, casting is performed together with a metal tube arranged in a mold, so that a molten resin channel having in a desired shape can be formed to reduce pressure loss. Further, since the functional members, such as a temperature-control tube and a heater, are also cast together at the same time, a hot runner manifold block that includes a temperature control function can be obtained, without the occurrence of temperature unevenness. Furthermore, when the martensitic cast steel material of the invention is employed, the obtained hot runner manifold block has superior corrosion resistance, equivalent to that of a commercially available steel material.

EXAMPLE 5

Plain Bearing for Press Dies

A plain bearing, for controlling the movable portion of a die and the travel direction of the die, is employed for a die set for applying pressure to a thick steel sheet to produce a large item, such as an automobile body. For this plain bearing, not only a strength that ensures various stresses are generated by pressure during the machining of a steel sheet, but also the total durability, such as corrosion resistance and wear resistance especially on the sliding face, are strongly requested. Conventionally, since it is difficult for all of the requested functions, including the manufacturing cost reduction, to be satisfied by using a single material, in order to cope with the requirements, a member that has superior wear resistance and corrosion resistance is employed for the sliding surface, e.g., a special member where graphite is embedded in the surface of a copper alloy is employed together. By contrast, since the martensitic cast steel material of the present invention has corrosion resistance and wear resistance, and the hardness of the surface can be increased by performing the tempering process in the nitrogen atmosphere, a special member for the sliding face is not required. In addition, since appropriate wear resistance is obtained merely by the sub-zero treatment for the martensitic cast steel material of the invention, the quenching process, which is required for hardening the conventional material to obtain wear resistance, is not required, and the manufacturing costs can be remarkably reduced.

[Industrial Applicability]

According to the martensitic cast steel material of the present invention, since casting and finishing is performed using a cast steel material having a predetermined composition ratio, and the sub-zero treatment is performed to cool the obtained steel material to a temperature below freezing, so that an appropriate hardness can be obtained without performing the quenching process. Further, the cast steel ingot obtained at the above composition ratio can be tempered and be machined as a product, and thereafter, the sub-zero treatment can be performed for the product.

Therefore, the obtained steel casting product can be employed for many applications that require a hardness at a predetermined level or higher, e.g., press dies, injection molding dies, tools for which hardness and precision at predetermined levels, or higher, are required, gears, forged products such as vehicle suspension parts and shafts, wheels of rail transport vehicles; eyebolts, beds and sliding members of machine tools, parts of agricultural machinery tools, such as rice polishing machines and threshing machines, pawls and cutting portions, etc., of construction machinery, fixed cutting blades of lawn mowers, snowplows, etc.

The applications for the product obtained by tempering and machining are, for example, copper alloy plates, wear plates employed for sliding portions, and impellers and runners for fluid machinery, such as turbines and pumps. Further, it is expected that the product obtained by enclosing an electric heater with a protective tube, a thermocouple, a resistance thermometer or various other types of sensors or temperature-control tubes, in a cast steel material, can be applied for barrels and screws of plastic melting-kneading extruders, and injection molding dies that require more accurate temperature control for heating or cooling. For these applications, the hardening process, which conventionally requires an enormous expenditure of thermal energy, is not necessary, and remarkable energy savings can be achieved. Therefore, great effects are also expected for a reduction in carbon dioxide emissions that is regarded as being closely related to environmental destruction.

The invention claimed is:

1. A martensitic cast steel material, characterized in that:

nickel, Ni, of 5 to 10 mass %, chromium, Cr, of 4 to 7 mass %, silicon, Si, of 0.5 to 5 mass %, manganese, Mn, of 0.01 to 1 mass %, carbon, C, of 0.2 to 2 mass %, and a remaining part consisting of iron, Fe, and incidental impurities are contained; and a martensitic transformation finish temperature (Mf point) is below freezing.

2. A martensitic cast steel material, characterized in that:

nickel, Ni, of 5 to 10 mass %, chromium, Cr, of 4 to 7 mass %, silicon, Si, of 0.5 to 5 mass %, manganese, Mn, of 0.01 to 1 mass %, vanadium, V, of 0.1 to 5 mass %, carbon, C, of 0.2 to 2 mass %, and a remaining part consisting of iron, Fe, and incidental impurities are contained; and a martensitic transformation finish temperature (Mf point) is below freezing.

3. The martensitic cast steel material according to claim 1, characterized by having a property that the martensitic transformation is completed simply by performing a sub-zero treatment.

4. The martensitic cast steel material according to claim 1, characterized in that:

a temperature range for the sub-zero treatment is from 020 C. to −200° C.; and the sub-zero treatment is performed for a cast steel material, in an as-cast state, that has a Rockwell C hardness scale of 20 to 60 HRC, and a property of the hardness of 45 to 65 HRC is obtained.

5. The martensitic cast steel material according to claim 1, characterized in that tempering is performed following the sub-zero treatment, and a property is obtained such that the hardness can be adjusted within a range of 40 to 60 HRC.

6. A manufacturing method for a martensitic steel casting product, characterized by comprising the steps of:

melting a raw material whose elements are adjusted according to claim 1;

casting the raw material to obtain a shape near that of a final product;

performing a finishing process for the thus obtained steel casting product;

performing a sub-zero treatment, at a temperature of 0° C. to −200° C., for the finished steel casting product; and tempering the resultant steel casting product within a temperature range of 100° C. to 700° C.

7. A manufacturing method for a martensitic steel casting product, characterized by comprising the steps of:

melting a raw material whose elements are adjusted according to claim 1;

casting the raw material to obtain a cast steel ingot;

performing a sub-zero treatment, at a temperature of 0° C. to −200° C., for the thus obtained cast steel ingot;

tempering the cast steel ingot within a temperature range of 100° C. to 700° C.; and machining the cast steel ingot that has been tempered, and producing a product.

8. The manufacturing method, for a martensitic steel casting product, according to claim 6, characterized in that a temperature for the sub-zero treatment is set that is equal to or lower than −50° C.

9. The manufacturing method, for a martensitic steel casting product, according to claim 6, characterized in that a temperature for the tempering is selected from within a range of 100° C. to 700° C., and in accordance with a hardness in a range of 40 to 60 HRC.

10. The martensitic cast steel material according to claim 2, characterized by having a property that the martensitic transformation is completed simply by performing a sub-zero treatment.

11. The martensitic cast steel material according to claim 2, characterized in that:

a temperature range for the sub-zero treatment is from 0° C. to −200° C.; and the sub-zero treatment is performed for a cast steel material, in an as-cast state, that has a Rockwell C hardness scale of 20 to 60 HRC, and a property of the hardness of 45 to 65 HRC is obtained.

12. The martensitic cast steel material according to claim 2, characterized in that tempering is performed following the sub-zero treatment, and a property is obtained such that the hardness can be adjusted within a desired range of 40 to 60 HRC.

13. A manufacturing method for a martensitic steel casting product, characterized by comprising the steps of:

melting a raw material whose elements are adjusted according to claim 2;

casting the raw material to obtain a shape near that of a final product;

performing a finishing process for the thus obtained steel casting product;

performing a sub-zero treatment, at a temperature of 0° C. to −200° C., for the finished steel casting product; and tempering the resultant steel casting product within a temperature range of 100° C. to 700° C.

14. A manufacturing method for a martensitic steel casting product, characterized by comprising the steps of:

melting a raw material whose elements are adjusted according to claim 2;

casting the raw material to obtain a cast steel ingot;

performing a sub-zero treatment, at a temperature of 0° C. to −200° C., for the thus obtained cast steel ingot;

tempering the cast steel ingot within a temperature range of 100° C. to 700° C.; and machining the cast steel ingot that has been tempered, and producing a product.

15. The manufacturing method, for a martensitic steel casting product, according to claim 7, characterized in that a temperature for the sub-zero treatment is set that is equal to or lower than −50° C.

16. The manufacturing method, for a martensitic steel casting product, according to claim 7, characterized in that a temperature for the tempering is selected from within a range of 100° C. to 700° C., and in accordance with a hardness in a range of 40 to 60 HRC.

* * * * *